US009108442B2

(12) United States Patent
Ito et al.

(10) Patent No.: US 9,108,442 B2
(45) Date of Patent: Aug. 18, 2015

(54) IMAGE FORMING APPARATUS

(71) Applicants: Yoichi Ito, Tokyo (JP); Soyoung Park, Kanagawa (JP); Yoshinori Uchino, Kanagawa (JP); Mikio Ohashi, Kanagawa (JP); Tadayasu Enomoto, Kanagawa (JP)

(72) Inventors: Yoichi Ito, Tokyo (JP); Soyoung Park, Kanagawa (JP); Yoshinori Uchino, Kanagawa (JP); Mikio Ohashi, Kanagawa (JP); Tadayasu Enomoto, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/454,090

(22) Filed: Aug. 7, 2014

(65) Prior Publication Data

US 2015/0054897 A1 Feb. 26, 2015

(30) Foreign Application Priority Data

Aug. 20, 2013 (JP) ..... 2013-170042
Aug. 20, 2013 (JP) ..... 2013-170101
Jun. 3, 2014 (JP) ..... 2014-115176

(51) Int. Cl.
*B41J 13/10* (2006.01)
*B41J 11/00* (2006.01)

(52) U.S. Cl.
CPC ..... *B41J 11/005* (2013.01)

(58) Field of Classification Search
USPC ..... 347/101, 244
See application file for complete search history.

(56) References Cited

U.S. PATENT DOCUMENTS

| | | | | |
|---|---|---|---|---|
| 5,257,038 | A * | 10/1993 | Ferschl et al. | 347/244 |
| 2006/0055754 | A1 | 3/2006 | Sakuma et al. | |
| 2006/0164491 | A1 | 7/2006 | Sakuma et al. | |
| 2006/0268087 | A1 * | 11/2006 | Sasa | 347/101 |
| 2007/0109385 | A1 | 5/2007 | Imoto et al. | |
| 2009/0058911 | A1 | 3/2009 | Kogure et al. | |
| 2012/0081487 | A1 | 4/2012 | Tanaka et al. | |
| 2012/0113180 | A1 | 5/2012 | Tanaka et al. | |
| 2012/0113204 | A1 | 5/2012 | Tanaka et al. | |
| 2012/0187622 | A1 * | 7/2012 | Kamichi | 271/171 |
| 2012/0187624 | A1 | 7/2012 | Ito et al. | |
| 2012/0206552 | A1 | 8/2012 | Uchino | |
| 2013/0020753 | A1 | 1/2013 | Ito | |
| 2014/0063121 | A1 | 3/2014 | Moriwaki et al. | |
| 2014/0092153 | A1 | 4/2014 | Kikkawa et al. | |
| 2014/0152745 | A1 | 6/2014 | Park | |

FOREIGN PATENT DOCUMENTS

| | | |
|---|---|---|
| JP | 63-197156 | 12/1988 |
| JP | 5-050672 | 3/1993 |
| JP | 6-297798 | 10/1994 |
| JP | 11-170643 | 6/1999 |
| JP | 2004-175017 | 6/2004 |
| JP | 2007-118480 | 5/2007 |
| JP | 2007-144633 | 6/2007 |
| JP | 2012-166449 | 9/2012 |

* cited by examiner

*Primary Examiner* — Stephen Meier
*Assistant Examiner* — John P Zimmermann
(74) *Attorney, Agent, or Firm* — Cooper & Dunham LLP

(57) ABSTRACT

An image forming apparatus including an image forming unit, a conveyor, and a string-shaped regulation member. The image forming unit forms an image on a recording medium. The conveyor is disposed opposing the image forming unit to convey the recording medium along a conveyance passage. The string-shaped regulation member is disposed between the image forming unit and the conveyance passage to regulate a distance between the recording medium and the image forming unit within a certain range.

20 Claims, 23 Drawing Sheets

IMAGE FORMING APPARATUS

CROSS-REFERENCE TO RELATED APPLICATIONS

This patent application is based on and claims priority pursuant to 35 U.S.C. §119(a) to Japanese Patent Application Nos. 2013-170042, filed on Aug. 20, 2013, 2013-170101, filed on Aug. 20, 2013, and 2014-115176, filed on Jun. 3, 2014, in the Japan Patent Office, the entire disclosure of each of which is hereby incorporated by reference herein.

BACKGROUND

1. Technical Field

Embodiments of this disclosure relate to an age forming apparatus.

2. Description of the Related Art

As an image forming apparatus such as a printer, a facsimile, a copier, a plotter, and a multifunctional device thereof, for example, an inkjet recording apparatus such as a liquid ejection recording type image forming apparatus is known which includes a recording head configured as a liquid ejection head (a droplet ejection head) ejecting an ink droplet. In such an image forming apparatus, for example, a configuration is known in which a recording medium is guided by a platen member while opposing an image forming unit and a guide member guiding the recording medium conveyed on the platen member and a sheet pressing member pressing a sheet are disposed so as to be movable in a direction perpendicular to a medium conveyance direction.

Particularly, in the case where an image is formed by the liquid ejection recording type, there is a need to maintain a narrow gap of, e.g., about 1 mm between the recording medium and a recording head configured as a liquid ejection head. For that reason, in the case where a regulation member (the guide member and the sheet pressing member) which presses the recording medium is disposed between the recording head and the platen member, there is a need to decrease the thickness of the regulation member.

BRIEF SUMMARY

In at least one embodiment of this disclosure, there is provided an image forming apparatus including an image forming unit, a conveyor, and a string-shaped regulation member. The image forming unit forms an image on a recording medium. The conveyor disposed opposing the image forming unit to convey the recording medium along a conveyance passage. The string-shaped regulation member is disposed between the image forming unit and the conveyance passage to regulate a distance between the recording medium and the image forming unit within a certain range.

In at least one embodiment of this disclosure, there is provided an image forming apparatus including an image forming unit, a conveyor, and a regulation member. The image forming unit forms an image on a recording medium. The conveyor is disposed opposing the image forming unit to convey the recording medium along a conveyance passage. The conveyor includes a pair of upstream-side rotary bodies at an upstream side of the image forming unit in a medium conveyance direction of the recording medium and a pair of downstream-side rotary bodies at a downstream side of the image forming unit in the medium conveyance direction. The regulation member is disposed between the image forming unit and the conveyance passage to regulate the recording medium. The regulation member includes an upstream-side support portion at an upstream side of the image forming unit in the medium conveyance direction to support the regulation member at the upstream side and a downstream-side support portion at a downstream side of the image forming unit in the medium conveyance direction to support the regulation member at the downstream side. The regulation member has a portion that is disposed between the pair of upstream-side rotary bodies and the image forming unit and extends in a vertical direction relative to the conveyance passage.

In at least one embodiment of this disclosure, there is provided an image forming apparatus including an image forming unit, a conveyor, and a regulation member. The image forming unit forms an image on a recording medium. The conveyor is disposed opposing the image forming unit to convey the recording medium along a conveyance passage. The conveyor includes a pair of upstream-side rotary bodies at an upstream side of the image forming unit in a medium conveyance direction of the recording medium and a pair of downstream-side rotary bodies at a downstream side of the image forming unit in the medium conveyance direction. The regulation member is disposed between the image forming unit and the conveyance passage to regulate the recording medium, the regulation member including an upstream-side support portion at an upstream side of the image forming unit in the medium conveyance direction to support the regulation member at the upstream side and a downstream-side support portion at a downstream side of the image forming unit in the medium conveyance direction to support the regulation member at the downstream side. The regulation member has a portion that is disposed between the pair of downstream-side rotary bodies and the image forming unit and extends in a vertical direction relative to the conveyance passage.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
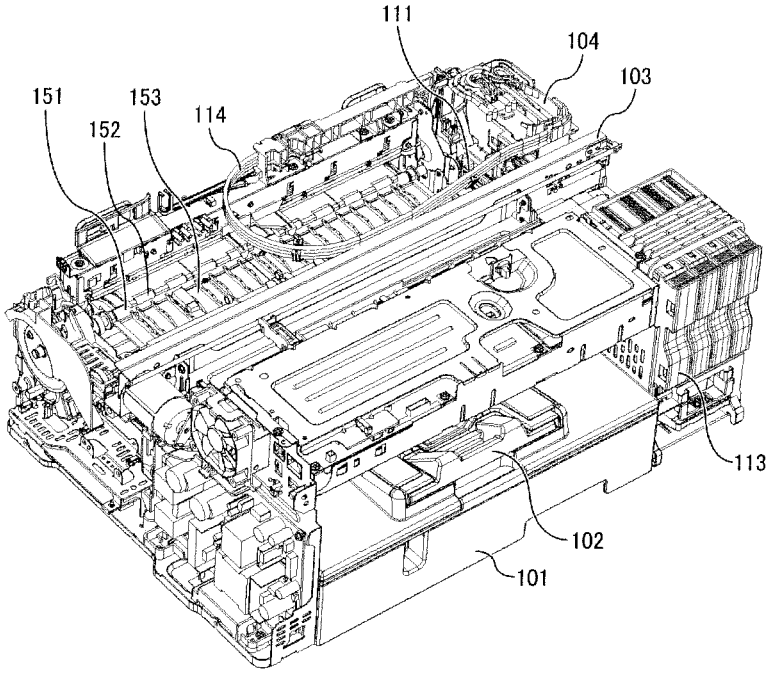
FIG. 1 is a perspective view illustrating an example of an image forming apparatus according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION OF EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

For example, in this disclosure, the term "sheet" used herein is not limited to a sheet of paper and includes anything such as OHP (overhead projector) sheet, cloth sheet, glass sheet, or substrate on which ink or other liquid droplets can be attached. In other words, the term "sheet" is used as a generic term including a recording medium, a recorded medium, a recording sheet, and a recording sheet of paper. The terms "image formation", "recording", "printing", "image recording" and "image printing" are used herein as synonyms for one another.

The term "image forming apparatus" refers to an apparatus that ejects liquid on a medium to form an image on the medium. The medium is made of, for example, paper, string, fiber, cloth, leather, metal, plastic, glass, timber, and ceramic. The term "image formation" includes providing not only meaningful images such as characters and figures but meaningless images such as patterns to the medium (in other words, the term "image formation" also includes only causing liquid droplets to land on the medium).

The term "ink" is not limited to "ink" in a narrow sense, unless specified, but is used as a generic term for any types of liquid usable as targets of image formation. For example, the term "ink" includes recording liquid, fixing solution, DNA sample, resist, pattern material, resin, and so on.

The term "image" used herein is not limited to a two-dimensional image and includes, for example, an image applied to a three dimensional object and a three dimensional object itself formed as a three-dimensionally molded image.

In addition, the ejecting direction of liquid is not limited to a vertically downward direction or a horizontal direction, and for example, may be an oblique direction or a vertically upward direction.

An image forming apparatus according to an embodiment of this disclosure is not limited to a serial-type image forming apparatus and, for example, may be a line-head-type image forming apparatus.

Referring now to the drawings, embodiments of the present disclosure are described below. In the drawings for explaining the following embodiments, the same reference codes are allocated to elements (members or components) having the same function or shape and redundant descriptions thereof are omitted below.

Figure 2:
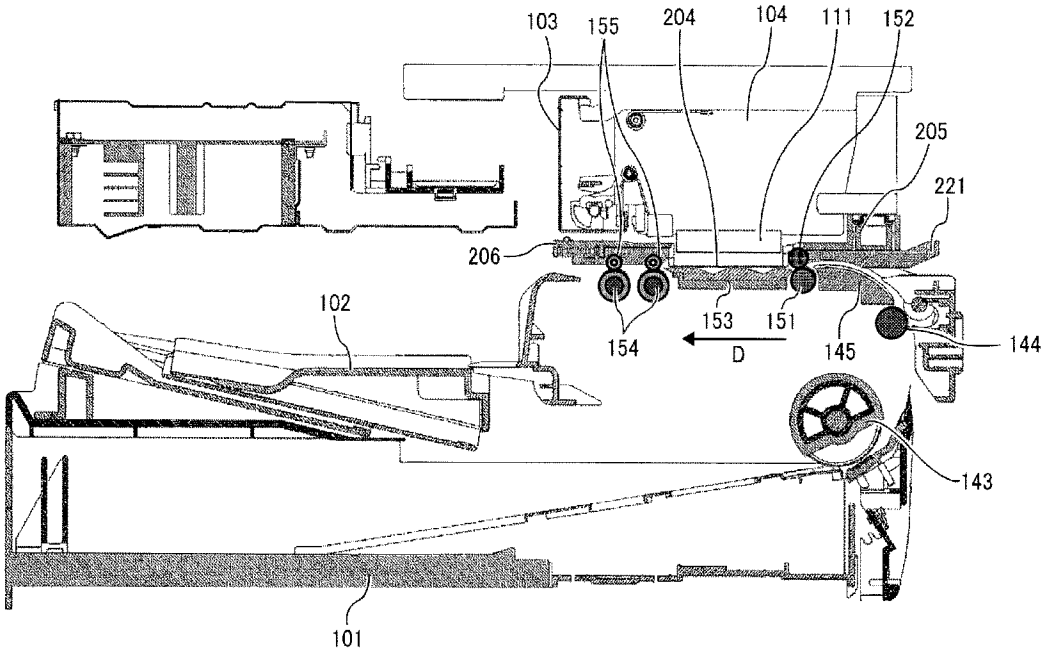
FIG. 2 is a side view illustrating the example according to an embodiment of this disclosure.

An image farming apparatus according to an embodiment of this disclosure will be described with reference to FIG. 1 and FIG. 2. FIG. 1 is a perspective view illustrating the image forming apparatus, and FIG. 2 is a side view illustrating the image forming apparatus.

The image forming apparatus is a serial-type image forming apparatus. A carriage 104 is supported by a loadless-type guide assembly using a guide member 103 formed as a plate member stretched between right and left side plates so that the carriage 104 is movable in a direction (a main scanning direction) perpendicular to a medium conveyance direction (a sub-scanning direction) indicated by arrow D in FIG. 2.

Further, the carriage 104 is equipped with a recording head 111 including a liquid ejection head as an image forming unit that ejects, for example, droplets of respective colors of yellow (Y), cyan (C), magenta (M), and black (K).

Ink (liquid) is supplied from an ink cartridge 113 as a liquid cartridge (a main tank) detachably attached to an apparatus body to the recording head 111 through a supply tube 114.

Meanwhile, a sheet feed cassette 101 that loads sheets 210 (see FIG. 4 below) as a recording medium is mounted on a bottom side of the apparatus body. The sheets 210 inside the sheet feed cassette 101 are delivered one by one by a sheet feed roller 143.

The sheet 210 which is fed from the sheet feed cassette 101 is sent to a gap between a conveyance roller 151 and a pressing roller 152 through a relay roller 144 and a conveyance guide plate 145. The conveyance roller 151 and the pressing roller 152 are a pair of rotary bodies disposed at the upstream side of the image forming unit in the medium conveyance direction D.

Then, the sheet is intermittently conveyed by a conveyance force generated by the conveyance roller 151 and the pressing roller 152 while being guided by a rib 153*a* of a platen member 153 as a conveyance guide member disposed to face the image forming unit.

At this time, when the recording head 111 is driven in response to an image signal while the carriage 104 is moved, an ink droplet is ejected to the stopped sheet 210 to perform a recording operation for one line, and the sheet 210 is conveyed by a predetermined amount to perform a recording operation for the next line. The recording operation ends when a recording end signal or a signal indicating the state where a tail end of the sheet 210 reaches a recording area is obtained.

Sheet discharge rollers 154 and spur rollers 155 are disposed at the downstream side of the platen member 153, and discharge the sheet 210 having an image formed thereon onto a sheet discharge tray 102. The sheet discharge rollers 154 and the spur rollers 155 are pairs of rotary bodies disposed at the downstream side of the image forming unit in the medium conveyance direction D.

Figure 3:
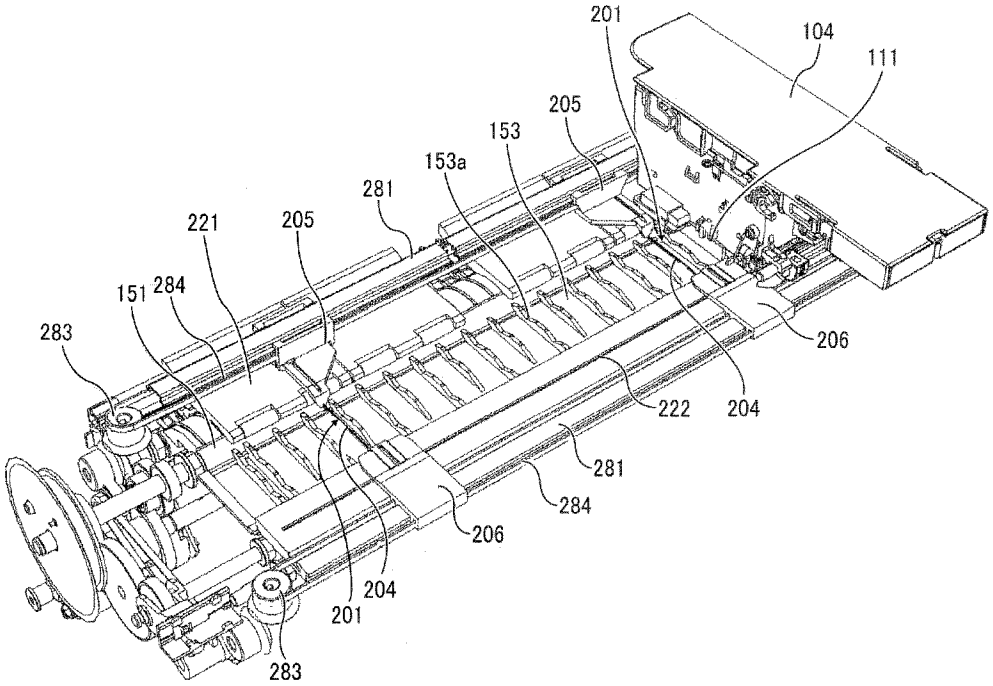
FIG. 3 is a perspective view illustrating a recording section (a printing section) according to a first embodiment of this disclosure.
Figure 4:
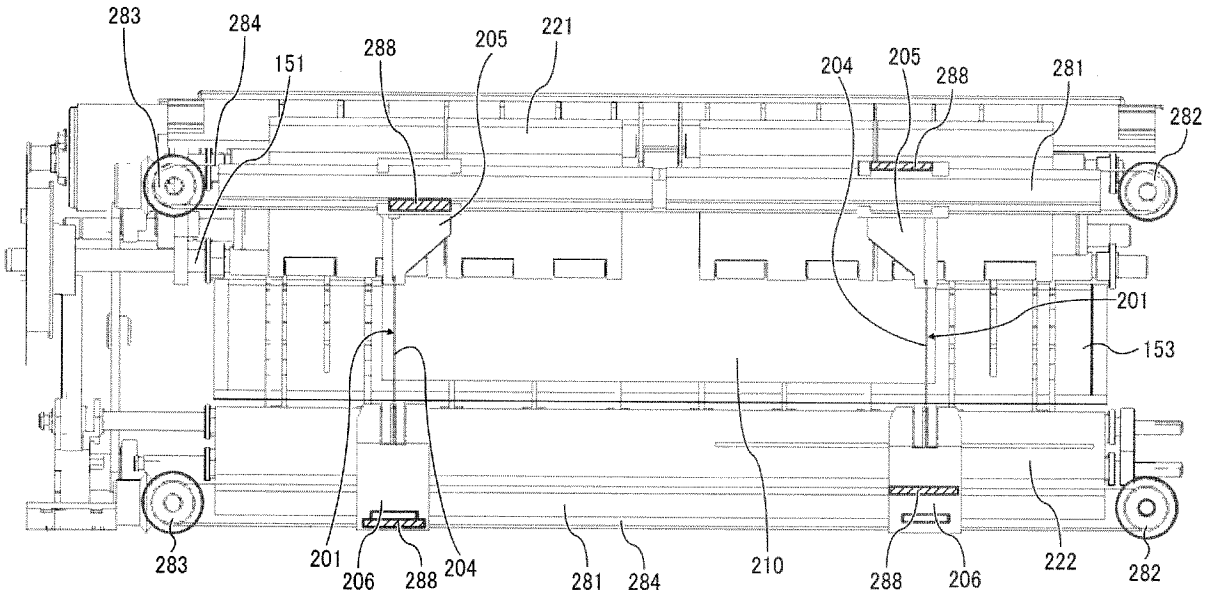
FIG. 4 is a plan view illustrating the recording section according to an embodiment of this disclosure.

Next, a first embodiment of this disclosure applied to the image forming apparatus will be described with reference to FIGS. 3 and 4. FIG. 3 is a perspective view illustrating a recording section (a printing section) of the first embodiment, and FIG. 4 is a plan view illustrating the first embodiment.

As described above, a platen member 153 forms a conveyance passage 160 through which the sheet 210 is conveyed.

Two regulators 201 which regulate the uplift of the sheet 210 are provided above the platen member 153 in the main scanning direction (the carriage moving direction).

The regulator 201 includes a regulation member 204 which is formed as a string-shaped member regulating the distance between the sheet 210 and the image forming unit (the recording head 111) within a uniform range and holding members 205 and 206 which hold the regulation member 204.

The holding members 205 and 206 are guide members which support the regulation member 204, and also serve as fixation portions which hold the regulation member 204 while fixing both ends thereof.

The regulation member 204 is a flexible string-shaped member (here, a "string"), and is held by two holding members 205 and 206 while a tension is applied thereto.

The platen member 153 includes a plurality of ribs 153*a* which guides the sheet 210 in a contact state, and the regulation member 204 is held at a position higher than the ribs 153*a*.

Further, the regulator 201 is held at a position which does not cause an interference with the carriage 104 and the recording head 111, and hence the regulator 201, the carriage 104, and the recording head 111 do not contact each other even when the carriage 104 scans the upside of the platen member 153 in order to perform a print operation.

Here, the holding members 205 and 206 of the regulator 201 are held so as to be movable in a direction parallel to the scan direction of the carriage 104 by a guide rail 281. Then, the holding members are moved by a motor through a timing belt 284 wound around pulleys 282 and 283.

The timing belt 284 is provided in each of the upstream side and the downstream side of the platen member 153 in the medium conveyance direction, the upstream-side timing belt 284 transmits a power to the upstream-side holding member 205, and the downstream-side timing belt 284 transmits a power to the downstream-side holding member 206.

The operations of the upstream-side timing belt 284 and the downstream-side timing belt 284 are synchronized with each other by a different timing belt, and hence the upstream-side holding member 205 and the downstream-side holding member 206 move in a synchronization state.

In this way, when the regulator 201 including the regulation member 204 moves in the main scanning direction, the upstream-side and downstream-side holding members 205 and 206 are operated in a synchronization state, and hence the regulator may move without any inclination in the scan direction of the carriage 104.

Further, in two holding members 205 connected to the upstream-side timing belt 284, the timing belt 284 having a loop shape is fixed and held by a fixation portion 288 at a different surface. Similarly, in two holding members 206 connected to the downstream-side timing belt 284, the timing belt 284 having a loop shape is fixed and held by the fixation portion 288 at a different surface.

Accordingly, when the timing belt 284 rotates, two regulators 201 are respectively operated in the opposite directions in the scan direction of the carriage 104. Thus, two regulators 201 move so as to be symmetrical to each other about the center in the width direction of the platen member 153 at all times.

When a print operation is performed, a controller reads the size of the sheet 210 in print information transmitted from a host, and moves the positions of the regulators 201 so as to match the size of the sheet 210 in the width direction.

The regulators 201 are moved so as to be located inside both ends in the width direction perpendicular to the medium conveyance direction of the sheet 210 conveyed along the platen member 153. Thus, when the sheet 210 is conveyed along the platen member 153, the end of the sheet 210 is nipped between the platen member 153 and the regulation members 204 of the regulators 201.

The regulation member 204 of the regulator 201 may suppress the uplift of the end of the sheet 210. That is, for example, even when the sheet 210 of which the end is easily lifted upward due to the damage and the bending of the sheet 210 is conveyed, the sheet is regulated at a position where the sheet does not contact the carriage 104 and the recording head 111 due to the regulation member 204 of the regulator 201. Thus, it is possible to prevent a failure (for example, a friction, a jam, or the like) caused by the contact of the sheet 210 with respect to the carriage 104 and the recording head Ill.

Further, an area where the regulation member 204 is located between the sheet 210 and the recording head 111 becomes an area where a print operation may not be performed on the sheet 210.

Therefore, since the thin string-shaped member is used as the regulation member 204, the end outside the printable area of the sheet 210 may be suppressed, and hence the uplift of the sheet may be reduced without decreasing the size of the printable area.

Further, since the regulation member 204 is formed as the string-shaped member, the regulation member 204 is bent by the contact with respect to the carriage 104, and hence the damage thereof may be prevented compared to a thin and flexible member such as Mylar having a uniform width.

Further, in a flat member such as mylar, when a deviation occurs in the width direction of the fixation member (the holding member) at the downstream side and the upstream side in the medium conveyance direction, the regulation member is twisted, and the regulation member is lifted upward. For that reason, there is a need to accurately synchronize the movement of the fixation members at the downstream side and the upstream side in the medium conveyance direction.

On the contrary, since the regulation member 204 is the string-shaped member, the regulation member 204 is not twisted even when a slight deviation occurs in the synchronization of the fixation member (the holding member). For this reason, there is no need to precisely synchronize the movement of the fixation members, and hence the fixation member moves easily.

Figure 5A:
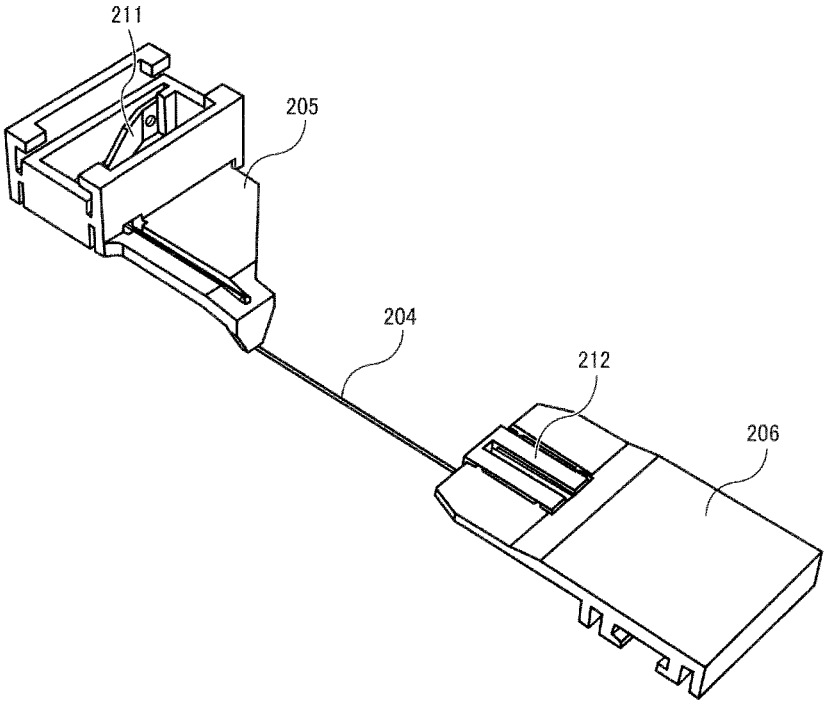
FIGS. 5A and 5B are perspective views illustrating a regulator according to the embodiment.
Figure 5B:
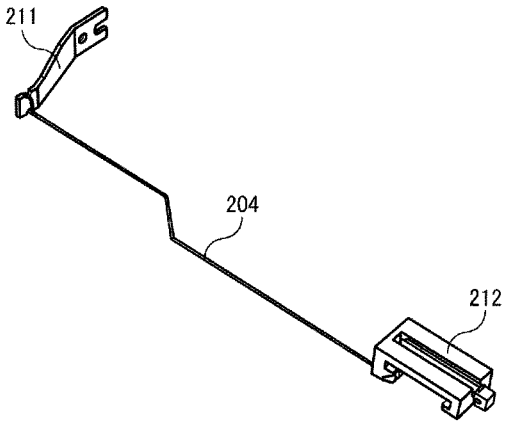

Next, the regulator of this embodiment will be described in detail with reference to FIGS. 5A and 5B. FIGS. 5A and 5B are perspective views illustrating the regulator, where FIG. 5A is a perspective view including the holding member, and FIG. 5B is a perspective view illustrating a laid passage of the regulation member except for the holding member. FIGS. 5A and 5B are perspective views illustrating the regulator.

A leaf spring 211 is provided inside the upstream-side holding member 205, and one end of the regulation member 204 is held by the holding member 205 through the leaf spring 211. One end of the regulation member 204 is formed in a loop shape, and is caught and held by a notch formed in the leaf spring 211.

Further, the downstream-side holding member 206 is provided with a fixation member 212, and the other end of the regulation member 204 is held by the holding member 206 through the fixation member 212. The other end of the regulation member 204 is held in a manner such that the loop-shaped end is caught by a pawl formed in the fixation member 212.

Here, since one end of the regulation member 204 is held by the holding member 205 through the leaf spring 211, the regulation member 204 is held while a tension is applied thereto. For this reason, the regulation member 204 is formed of a flexible material, but is held in a tension application state, so that the regulation member is held in a shape along the shapes of the holding members 205 and 206 as illustrated in FIG. 13A.

Further, since one end of the regulation member 204 is held by the leaf spring 211, a certain degree of deformation of the regulation member 204 is allowed.

Here, for example, when the sheet 210 is stopped on the platen member 153 due to a certain reason during the print operation, a user needs to remove the sheet 210 on the platen member 153. At this time, since the regulation member 204 is formed of a flexible material as described above, a certain degree of deformation is allowed. During such clearance, the sheet 210 stopped on the platen member 153 may be removed without damaging the regulation member 204 or the holding members 205 and 206.

Figure 6:
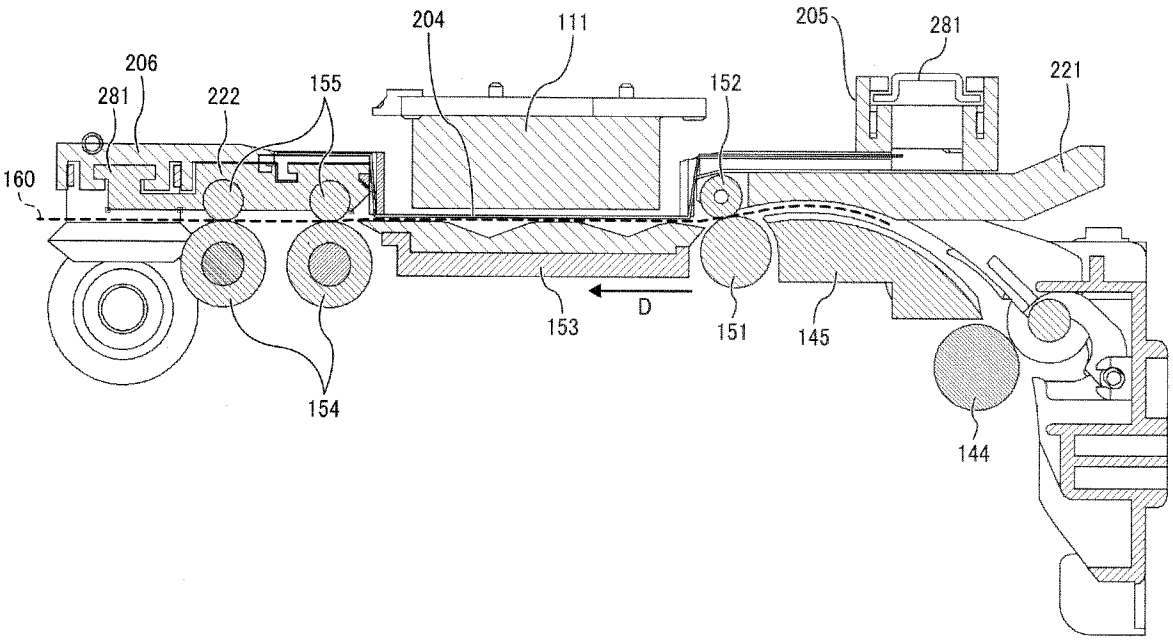
FIG. 6 is a side view illustrating the arrangement of a regulator of the embodiment.

Next, the arrangement of the regulator 201 of this embodiment will be described with reference to FIG. 6. FIG. 6 is a side view illustrating the arrangement.

The conveyance roller 151 and the pressing roller 152 which sends the sheet 210 onto the platen member 153 are provided at the upstream side of the platen member 153 in the medium conveyance direction D.

The sheet discharge rollers 154 and the spur rollers 155 which send the sheet 210 delivered from the platen member 153 to the sheet discharge tray 102 are provided at the downstream side of the platen member 153 in the medium conveyance direction D.

Here, the pressing roller 152 is held by the apparatus body through a pressing plate 221. Further, the spur rollers 155 is held by the apparatus body through a spur holder 222.

Then, both ends of the regulation member 204 are respectively held by the upstream-side holding member 205 provided above the pressing plate 221 and the downstream-side holding member 206 provided above the spur holder 222.

Thus, the holding members 205 and 206 as the guide members are located near the recording head 111 in relation to the position of the regulation member between the recording head 111 and the recording medium conveyance passage 160. Further, both ends of the regulation member 204 are disposed through the upside of the pressing roller 152 and the spur rollers 155, that is, the opposite side to the conveyance passage 160.

Here, the upstream-side holding member 205 is movably held by the guide rail 281 held by the apparatus body. The downstream-side holding member 206 is movably held by the guide rail 281 (the rail) provided in the spur holder 222 held by the apparatus body.

The front ends of the holding members 205 and 206 respectively extend from the upper surfaces of the pressing plate 221 and the spur holder 222 to the vicinity of the platen member 153 so as to cover the end near the platen member 153.

Then, the flexible regulation member 204 is disposed so as to pass through a gap between the recording head 111 and the platen member 153 on the platen member 153 along the shapes of the holding members 205 and 206.

When the regulation member 204 and the holding members 205 and 206 are formed in this way, the regulation member 204 and the holding members 205 and 206 are movable to an arbitrary position in the main scanning direction. Further, since these members are disposed at a position where any interference with the recording head 111 does not occur, the operation of the recording head 111 is not disturbed during the print operation.

Further, only the regulation member 204 is disposed between the platen member 153 and the recording head 111. However, since the regulation member 204 is formed as the string-shaped member, the thickness may be decreased compared to, for example, a regulation member formed as a thin plate such as sheet metal. Accordingly, since an increase in distance between the platen member and the recording head may be suppressed due to the addition of the regulation member, and hence a satisfactory image may be obtained by the liquid ejection recording type.

Furthermore, the holding members 205 and 206 as the guide members are located near the recording head 111 in relation to the position of the regulation member 204 between the recording head 111 as the image forming unit and the recording medium conveyance passage 160. Thus, the sheet 210 may be conveyed along the platen member 153 without causing any interference when the sheet 210 is conveyed along the platen member 153.

Figure 7:
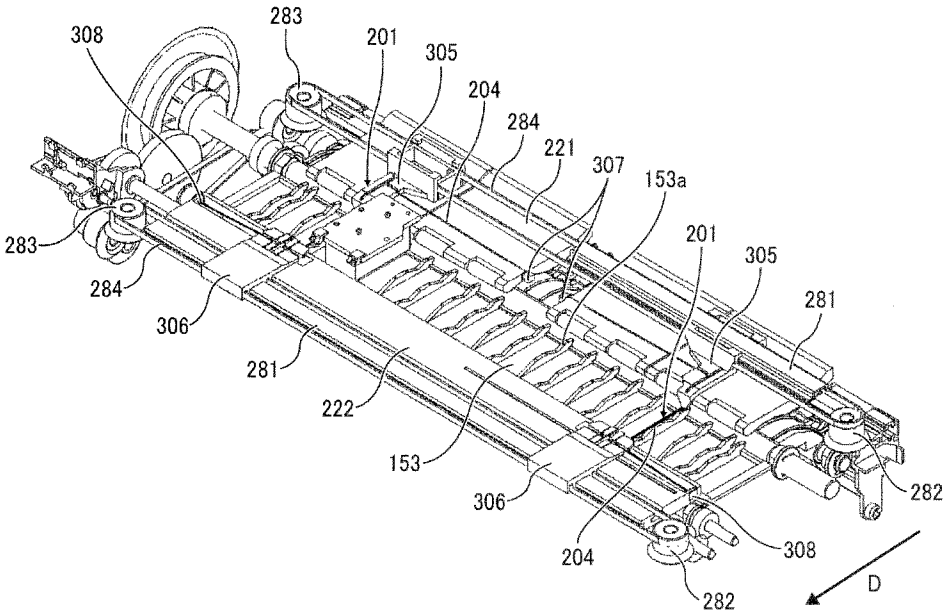
FIG. 7 is a perspective view illustrating a recording section (a printing section) according to a second embodiment of this disclosure.
Figure 8:
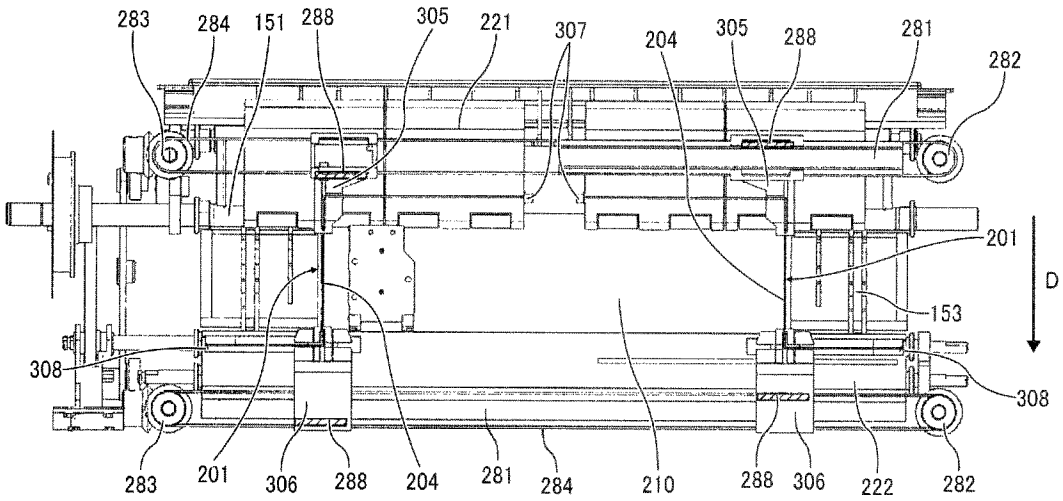
FIG. 8 is a plan view illustrating the recording section according to an embodiment of this disclosure.

Next, a second embodiment of this disclosure will be described with reference to FIGS. 7 and 8. FIG. 7 is a perspective view illustrating a recording section (a printing section) of the second embodiment, and FIG. 8 is a plan view illustrating the recording section.

In this embodiment, both ends of the regulation member 204 of the regulator 201 are respectively fixed and held by holding portions (fixation portions) 307 and 308 which are provided in the pressing plate 221 and the spur holder 222 and are different from guide members 305 and 306, and the halfway portions thereof are held and guided by the guide members 305 and 306.

Here, the guide members 305 and 306 of the regulator 201 are held so as to be movable in a direction parallel to the scan direction of the carriage 104 by the guide rail 281 similarly to the holding members 205 and 206 of the first embodiment. Then, the guide members are moved by a motor through the timing belt 284 wound around the pulleys 282 and 283.

The timing belt 284 is provided in each of the upstream side and the downstream side of the platen member 153 in the medium conveyance direction D, the upstream-side timing belt 284 transmits a power to the upstream-side guide member 305, and the downstream-side timing belt 284 transmits a power to the downstream-side guide member 306.

The operations of the upstream-side timing belt 284 and the downstream-side timing belt 284 are synchronized with each other by a different timing belt, and hence the upstream-side guide member 305 and the downstream-side guide member 306 move in a synchronization state.

In this way, when the regulator 201 including the regulation member 204 moves in the main scanning direction, the upstream-side and downstream-side guide members 305 and 306 are operated in a synchronization state, and hence the regulator may move without any inclination in the scan direction of the carriage 104.

Further, in two guide members 305 connected to the upstream-side timing belt 284, the timing belt 284 having a loop shape is fixed and held by a fixation portion 288 at a different surface. Similarly, in two guide members 306 connected to the downstream-side timing belt 284, the timing belt 284 having a loop shape is fixed and held by the fixation portion 288 at a different surface.

Accordingly, when the timing belt 284 rotates, two regulators 201 are respectively operated in the opposite directions in the scan direction of the carriage 104. Thus, two regulators 201 move so as to be symmetrical to each other about the center in the width direction of the platen member 153 at all times.

When a print operation is performed, a controller reads the size of the sheet 210 in print information transmitted from a host, and moves the positions of the regulators 201 so as to match the size of the sheet 210 in the width direction.

Figure 9A:
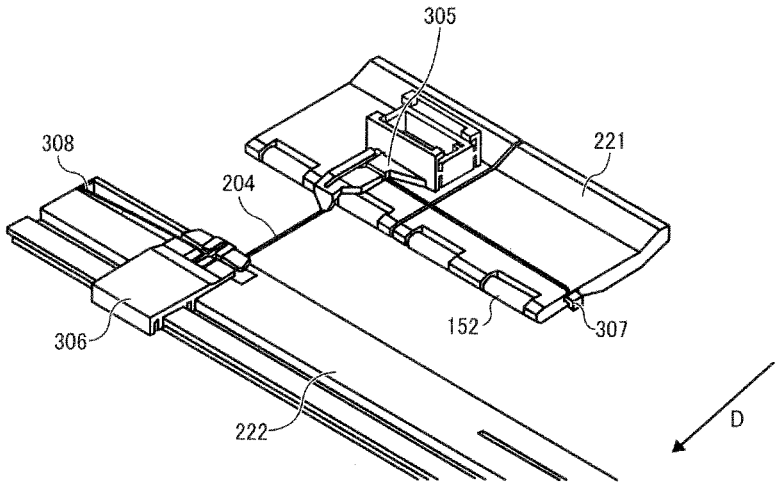
FIGS. 9A and 9B perspective views illustrating a regulator of the embodiment.
Figure 9B:
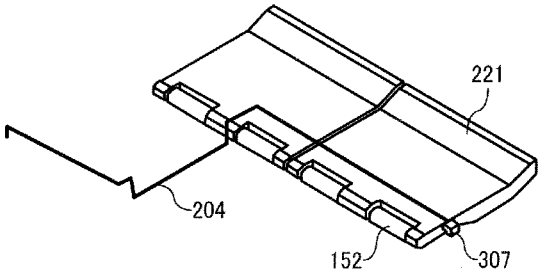

Next, the regulator 201 of this embodiment will be described in detail with reference to FIGS. 9A and 9B. FIGS. 9A and 9B are perspective views illustrating the regulator, where FIG. 9A is a perspective view illustrating the guide member, and FIG. 9B is a perspective view illustrating a laid passage of the regulation member except for the guide member.

One end of the regulation member 204 is laid in a direction perpendicular to the medium conveyance direction D while the halfway portion thereof is supported by the upstream-side guide member 305 in the medium conveyance direction D, and the loop-shaped portion formed at the end is caught and held by a projection 307 formed in the pressing plate 221.

The other end of the regulation member 204 is laid in a direction perpendicular to the medium conveyance direction D while the halfway portion thereof is supported by the downstream-side guide member 306 in the medium conveyance direction D, and a loop-shaped portion formed in the end is caught and held by a fixation portion 308 formed in the spur holder 222.

In this way, since the end of the regulation member 204 is held by a member forming the conveyance passage 160 such as a pressing plate or a spur holder, it is possible to decrease the number of components used for the fixing operation.

Figure 10A:
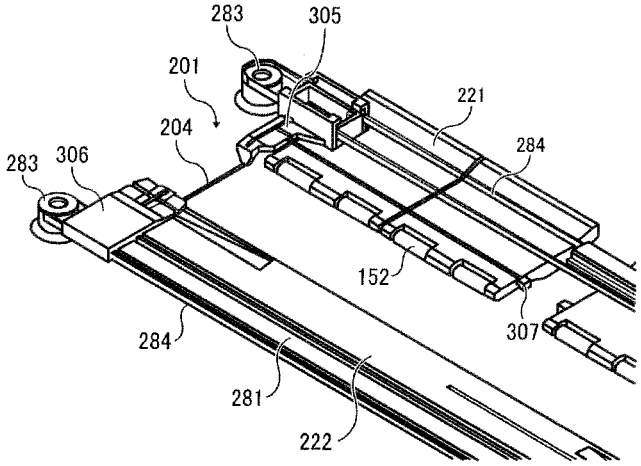
FIGS. 10A and 10B are perspective views illustrating the movement range of the regulator according to an embodiment of this disclosure.
Figure 10B:
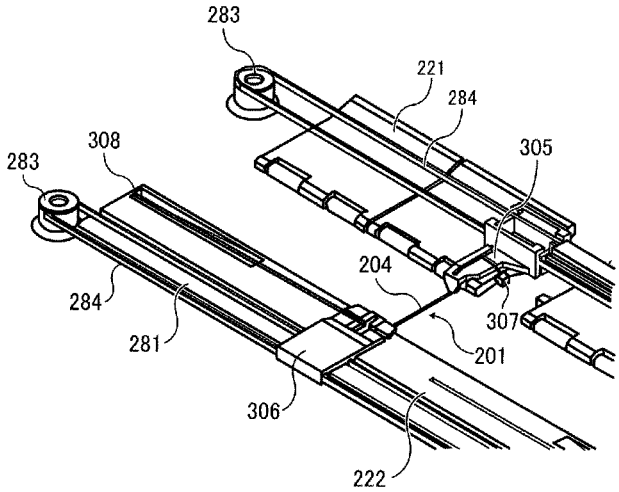

Next, regulator movement range will be described with reference to FIGS. 10A and 10B. FIGS. 10A and 10B are perspective views illustrating the regulator movement range.

The regulation member 204 of the regulator 201 and the guide members 305 and 306 may handle the maximum-width sheet while moving to a position illustrated in FIG. 10A, and may handle the minimum-width sheet while moving to a position illustrated in FIG. 10B.

Further, when the guide members 305 and 306 move due to the sheet size, an area of the regulation member 204 facing, a printing face also moves. For this reason, a contamination caused by an ink mist does is dispersed without concentrating on a partial position compared to the case where the regulation member 204 is fixed to the guide member, and hence the product life of the regulation member 204 may be extended.

Figure 11A:
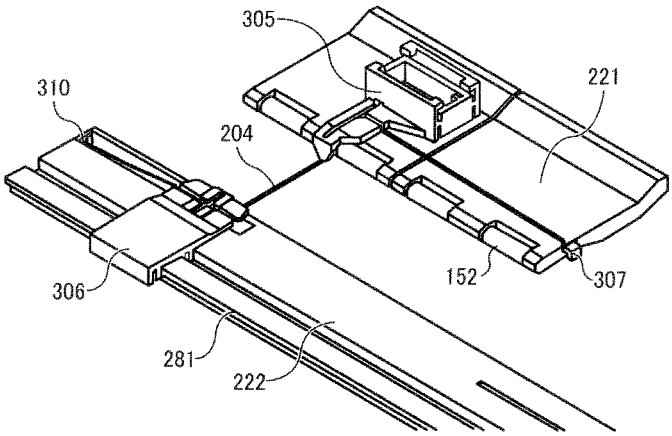
FIGS. 11A and 11B are perspective views illustrating a regulator according to a third embodiment of this disclosure.
Figure 11B:
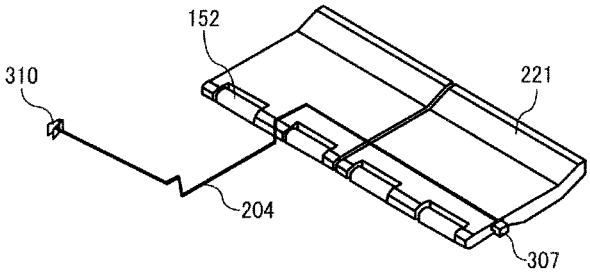

Next, a third embodiment of this disclosure will be described with reference to FIGS. 11A and 11B. FIGS. 11A and 11B are perspective views illustrating a regulator of the third embodiment, where FIG. 11A is a perspective view including a guide member, and FIG. 11B is a perspective view illustrating a laid passage of a regulation member except for the guide member.

In this embodiment, the end of the regulation member 204 fixed to the spur holder 222 is fixed by an elastic member 310 such as a leaf spring. Furthermore, the end fixed to the pressing plate 221 may be also fixed by an elastic member to a position other than the spur holder 222 or the position of the spur holder 222.

In this way, since at least one end of the regulation member 204 is fixed by the elastic member, the regulation member 204 may be deformed by a certain degree.

Thus, it is possible to reduce the damage of the regulation member 204 during the clearance of the jam as in the first embodiment.

For example, when the sheet 210 is stopped on the platen member 153 due to a certain reason during the print operation, the user needs to remove the sheet 210 on the platen member 153. At this time, since the regulation member 204 is formed of a flexible material and a certain degree of deformation thereof is allowed, it is possible to remove the sheet 210 stopped on the platen member 153 without damaging the regulation member 204 or the guide members 305 and 306 during such clearance.

Figure 12:
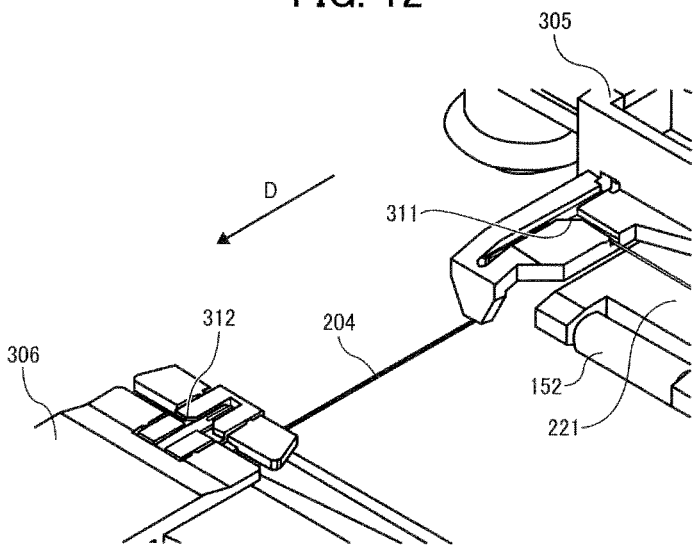
FIG. 12 is a perspective view illustrating a regulator according to a fourth embodiment of this disclosure.

Next, a fourth embodiment of this disclosure will be described with reference to FIG. 12. FIG. 12 is a perspective view illustrating a regulator of the fourth embodiment.

In this embodiment, curved portions 311 and 312 as laid portions for switching the direction of the regulation member 204 of the guide members 305 and 306 from the medium conveyance direction D to a direction intersecting the medium conveyance direction D are formed in an obtuse angle shape (or a curved surface shape).

Thus, the abrasion of the regulation member 204 or the guide members 305 and 306 may be reduced.

Figure 13:
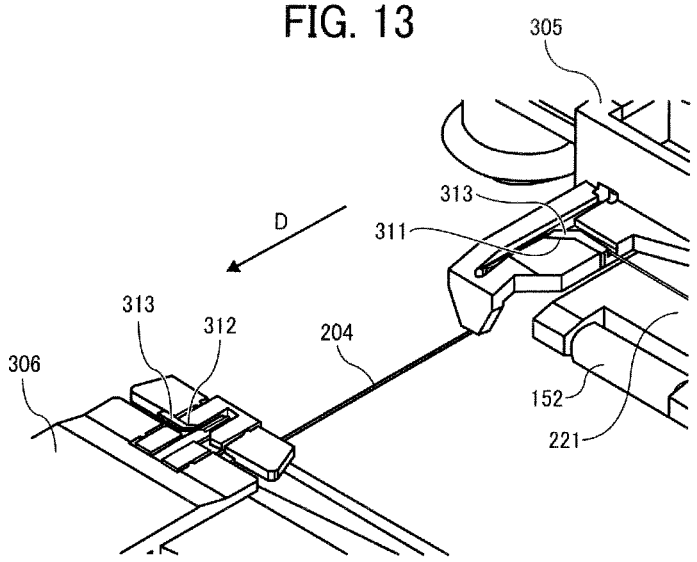
FIG. 13 is a perspective view illustrating a regulator according to a fifth embodiment of this disclosure.

Next, a fifth embodiment of this disclosure will be described with reference to FIG. 13. FIG. 13 is a perspective view illustrating a regulator of the fifth embodiment.

In this embodiment, a wiping member 313 which wipes off the circumferential surface of the regulation member 204 is disposed in the curved portions 311 and 312 which switch the direction of the regulation member 204 of the guide members 305 and 306 from the medium conveyance direction D to a direction intersecting the medium conveyance direction D.

That is, in the case of the liquid ejection type image forming apparatus, a mist or the like easily adheres to the regulation member 204. Then, when the sheet 210 contacts the regulation member 204 while the mist adheres to the regulation member, the image quality is degraded.

Here, in this embodiment, since both ends of the regulation member 204 are fixed to a member different from the guide members 305 and 306, the surface of the regulation member 204 is wiped off by the wiping member 313 so as to be cleaned by the movement of the guide members 305 and 306. Thus, it is possible to remove a contamination caused by the adherence of the mist, and hence to prevent degradation in print quality.

Figure 14:
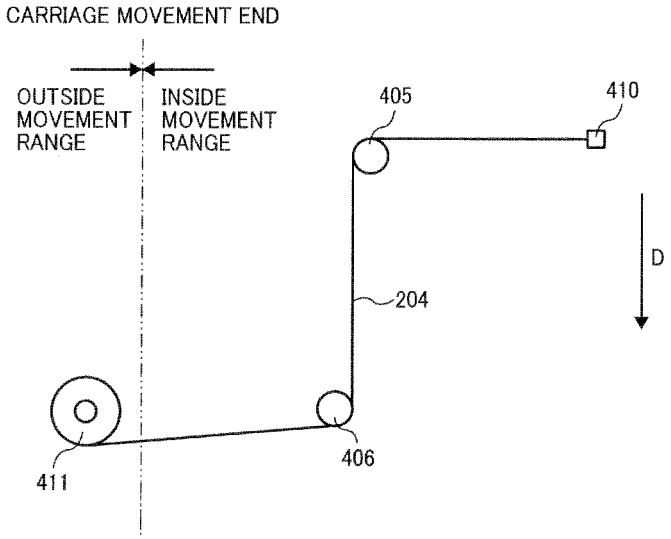
FIG. 14 is a schematic plan view illustrating a sixth embodiment of this disclosure.

Next, a sixth embodiment of this disclosure will be described. FIG. 14 is a schematic plan view illustrating the sixth embodiment.

In this embodiment, one end of the regulation member 204 of the regulator 201 is held by a holding portion 410 of the pressing plate 221. Then, the halfway portion of the regulation member 204 is supported by the guide member 405 so that the direction of the regulation member is switched from the main scanning direction to the medium conveyance direction D, and the halfway portion thereof is supported by the guide member 406 so that the direction thereof is switched from the medium conveyance direction D to the main scanning direction.

Then, the other end of the regulation member 204 of the regulator 201 is held by a holding portion 411 provided in an area other than the main scanning area of the carriage 104.

Here, the holding portion 411 is formed of a reel member around which the regulation member 204 is wound by a desired amount. When the reel member is rotated in reverse, the regulation member 204 is loosened.

Thus, when a jam or the like occurs, the jam may be cleared after the regulation member 204 is loosened.

That is, when the regulation member 204 is retracted in the event of the jam, there is a concern that the regulation member 204 may be damaged while being caught by the jammed sheet. Therefore, when the regulation member 204 is loosened in the event of the jam, the damage of the regulation member 204 may be prevented.

Further, in this embodiment, since the length of the regulation member 204 may be changed, the regulation member 204 may be disposed in an inclined state, for example, in a manner such that the guide member 405 is moved to the center side and the guide member 406 is moved to the end side in the main scanning direction. However, in this case, the upstream-side guide member 405 and the downstream-side guide member 406 are adapted to be separately driven.

Figure 15:
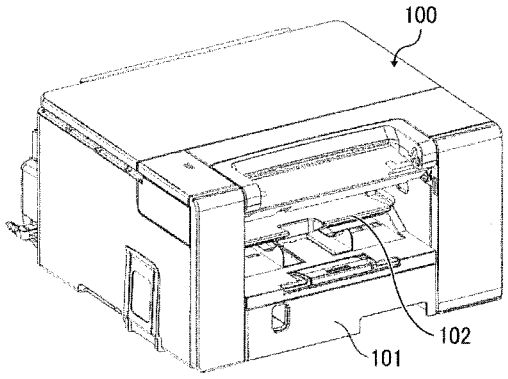
FIG. 15 is a perspective view illustrating an appearance of an image forming apparatus according to a seventh embodiment of this disclosure.
Figure 16:
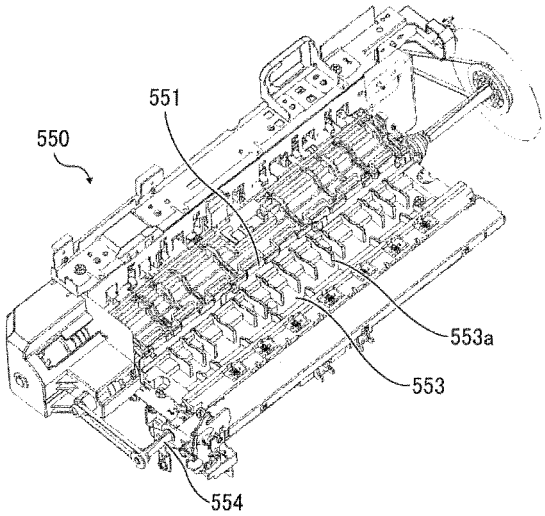
FIG. 16 is a perspective view illustrating a conveyance section of the image forming apparatus according to an embodiment of this disclosure.
Figure 17:
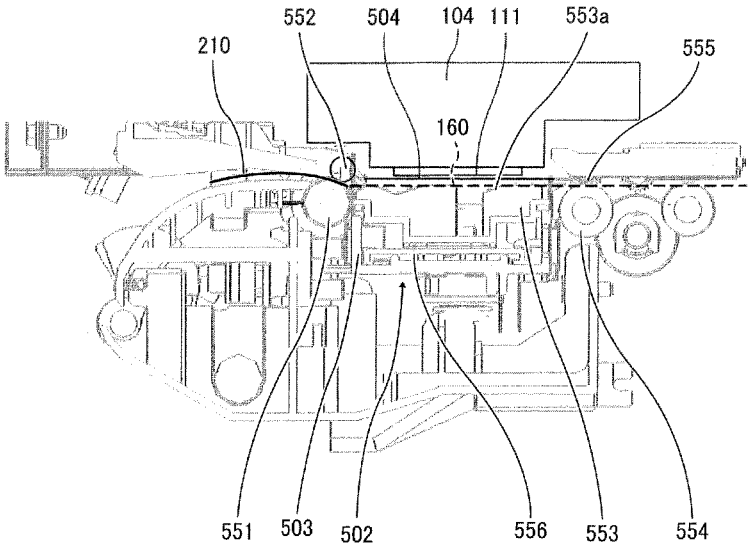
FIG. 17 is a cross-sectional side view illustrating the conveyance section according to an embodiment of this disclosure.
Figure 18:
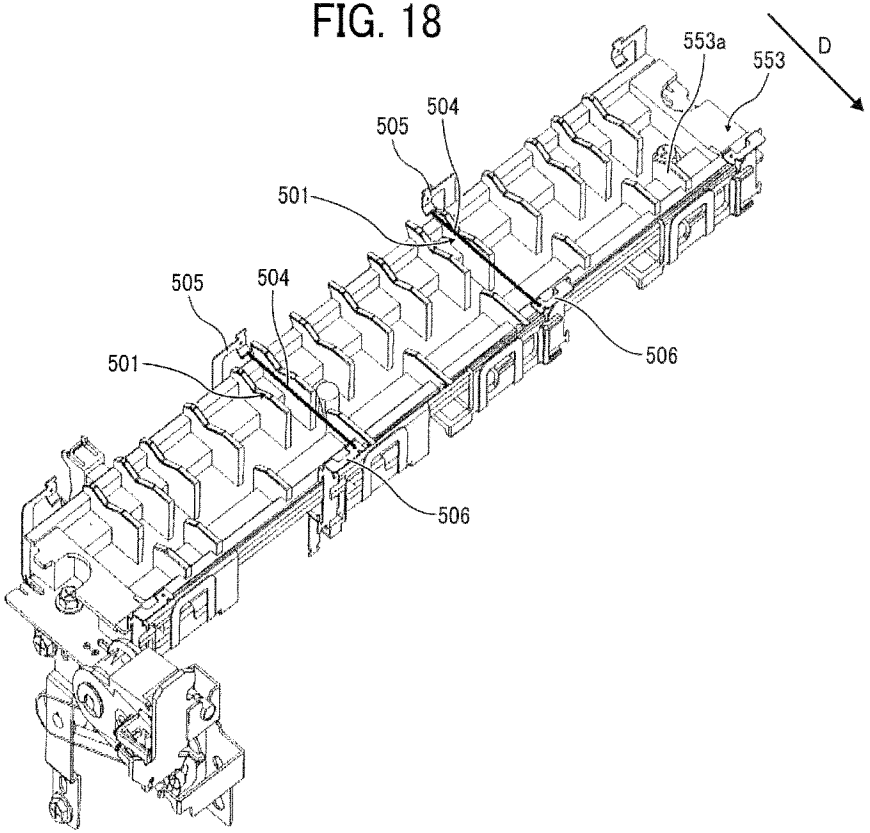
FIG. 18 is a perspective view illustrating a platen member as a conveyance guide member according to an embodiment of this disclosure.
Figure 19:
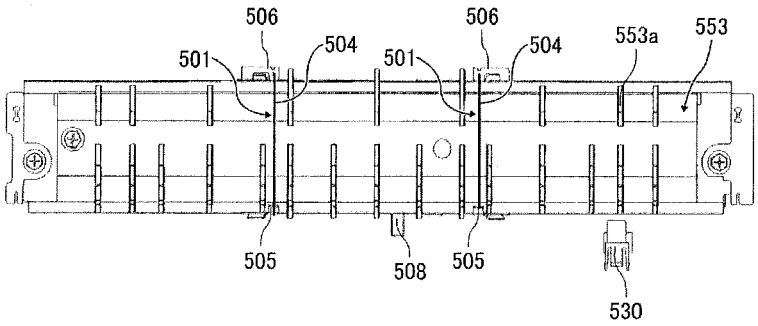
FIG. 19 is a plan view illustrating the platen member according to an embodiment of this disclosure.
Figure 20:
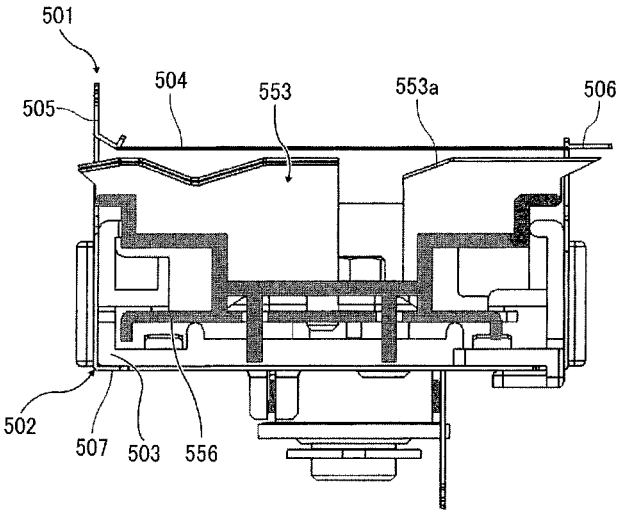
FIG. 20 is a cross-sectional side view illustrating the platen member according to an embodiment of this disclosure.
Figure 21:
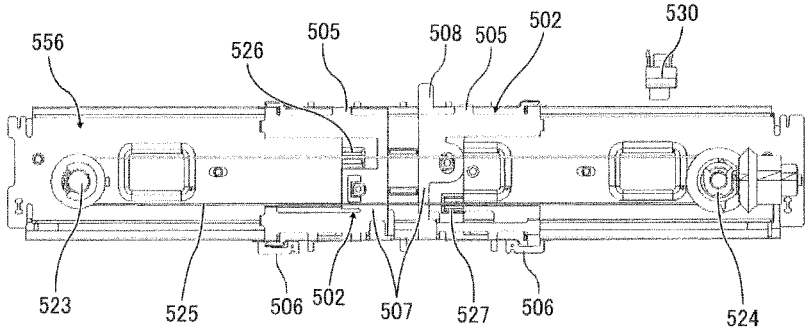
FIG. 21 is a bottom view illustrating the platen member according to an embodiment of this disclosure.

Next, a seventh embodiment of this disclosure will be described with reference to FIGS. 15 to 23. FIG. 15 is a perspective view illustrating an appearance of an image forming apparatus according to the seventh embodiment, FIG. 16 is a perspective view illustrating a conveyance section of the image forming apparatus, FIG. 17 is a cross-sectional side view illustrating the conveyance section, FIG. 18 is a perspective view illustrating a platen member as a conveyance guide member, FIG. 19 is a plan view illustrating a platen member, FIG. 20 is a cross-sectional side view illustrating the platen member, and FIG. 21 is a bottom view illustrating the platen member.

In the image forming apparatus, the carriage 104 equipped with the recording head 111 as the image forming unit and a conveyance assembly 550 as a conveyor conveying the sheet 210 while opposing the recording head 111 are disposed inside the apparatus body 100.

Then, similarly to the image forming apparatus, an image is formed on the sheet 210 by the recording head 111 while the sheet 210 fed from the sheet feed cassette 101 is conveyed by the conveyance assembly 550, and the recording medium having an image formed thereon is discharged to the sheet discharge tray 102.

The conveyance assembly 550 includes a conveyance roller 551, a pressing roller 552, a platen member 553 which serves as a conveyance guide member guiding the sheet 210 while facing the recording head 111, a sheet discharge roller 554, and a spur 555. The platen member 553 includes a plurality of ribs 553*a* to guide the sheet 210.

Then, regulators 501 including regulation members 504 are formed as string-shaped members as in the regulation member 204 disposed between the platen member 553 and the recording head 111 as the image forming unit.

The regulator 501 includes a guide member 502 which supports the regulation member 504 at the upstream side and the downstream side of the image forming unit in the medium conveyance direction D, and the guide member 502 is provided in the platen member 553 so as to be movable in a direction perpendicular to the medium conveyance direction D.

Here, the guide member 502 includes an upstream-side holding portion 505 which supports the regulation member 504 at the upstream side of the image forming unit in the medium conveyance direction D, a downstream-side holding portion 506 which supports the regulation member 504 at the downstream side of the image forming unit in the medium conveyance direction D, and a connecting portion 507 which connects the upstream-side holding portion 505 and the downstream-side holding portion 506 to each other.

Then, the guide member 502 includes a moving member 503 which is provided at the opposite side to the recording medium guide side of the platen member 553 so as to be movable in a direction perpendicular to the medium conveyance direction D.

The moving member 503 is movably held by a platen rail 556 fixed to the bottom surfaces (the rear surface in the conveyance passage 160) of the platen member 553 and the platen member 553. Furthermore, the platen member 553 and the platen rail 556 may be integrally formed with each other by a resin or the like. In this case, the number of components may be decreased.

Then, the connecting portion 507 of the guide member 502 is attached to the moving member 503.

As a driving assembly which moves the moving member 503 in the main scanning direction, the bottom surface of the platen rail 556 is provided with pulleys 523 and 524 and a timing belt 525 wound around the pulleys 523 and 524.

Then, the moving members 503 of the regulator 501 are fixed to the different surfaces of the timing belt 525 by belt clamps 526 and 527, and the right and left moving members 503 and 503 are operated in the rotation direction of the single timing belt 525 so as to move in approaching and separation directions.

Furthermore, the rotation of the timing belt 525 is performed by a driving motor through a different timing belt or a gear transmission assembly. Further, the timing belt may be replaced by a different belt such as a flat belt or a ring belt, and the belt type is not limited to the timing belt.

Further, the moving member 503 is provided with a convex portion 508, and the convex portion 508 is detected by an apparatus body side sensor 530, so that the position of the moving member 503 (the position of the regulation member 504) is detected.

Figure 22:
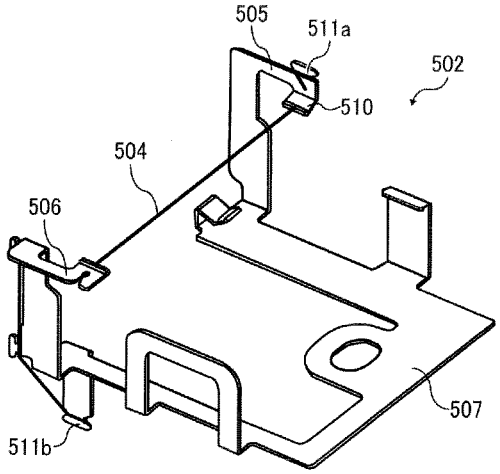
FIG. 22 is a perspective view illustrating a guide member including a regulator according to an embodiment of this disclosure.
Figure 23:
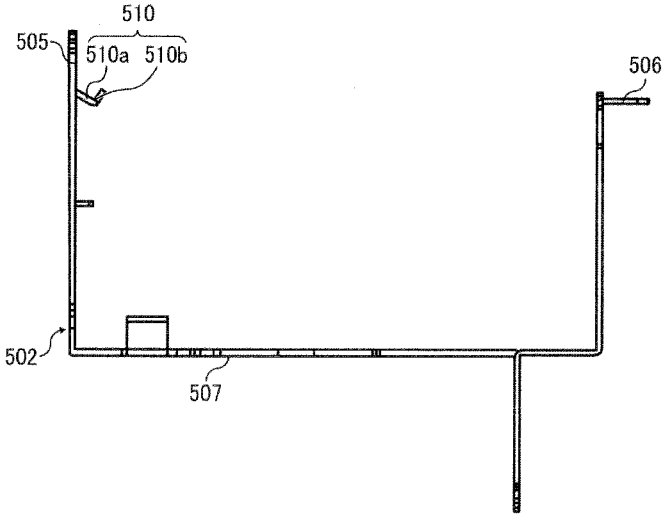
FIG. 23 is a side view illustrating the guide member according to an embodiment of this disclosure.

Here, the guide member 502 will be described with reference to FIGS. 22 and 23. FIG. 22 is a perspective view illustrating a guide member including a regulator, and FIG. 23 is a side view illustrating the guide member.

The guide member 502 includes the upstream-side holding portion 505 and the downstream-side holding portion 506 which are uprightly formed in the end of the connecting portion 507 having a C-shape in a plan view and are curved in the main scanning direction.

Then, the upstream-side holding portion 505 is provided with a protrusion 510 which protrudes toward the platen member 553 so as to determine the height of the regulation member 504. The protrusion 510 includes continuous tapered portions 510*a* and 510*b*.

That is, the protrusion 510 which protrudes toward the platen member 553 becomes a portion which first contacts the sheet 210 compared to the regulation member 504 when the sheet 210 is lifted upward. Therefore, since the protrusion 510 is provided with the tapered portions 510*a* and 510*b*, it is possible to prevent the recording medium from being caught during the conveying operation thereof.

Further, the upstream-side end of the regulation member 504 is fixed and held by a cutout portion 511*a* provided in the upstream-side holding portion 505, and the downstream-side end thereof is fixed and held by a cutout portion 511*b* provided in the connecting portion 507 in the vicinity of the upright portion of the downstream-side holding portion 506.

Furthermore, the tapered portions 510*a* and 510*b* are integrally formed with the upstream-side holding portion 505, but may be formed separately from each other. Further, the shape of preventing the caught state is not limited to the shape of FIG. 23.

In this way, since the guide member 502 that supports the regulation member 504 at the upstream side and the downstream side in the medium conveyance direction D is provided in the conveyance guide member (the platen member 553) so as to be movable in a direction perpendicular to the medium conveyance direction D, it is possible to reduce the positional deviation of the regulation member at the upstream side and the downstream side compared to the configuration in which the upstream-side and downstream-side guide members are separately moved as in the above-described embodiments.

That is, since the guide members are separately provided at the upstream side and the downstream side, a positional deviation may occur in the main scanning direction at the upstream side and the downstream side of the regulation member. For that reason, there is a need to take a large superimposed width (margin) of the regulation member with respect to the end of the recording medium in the width direction in order to prevent the deviation of the regulation member from the end of the recording medium or the adherence of the droplet with respect to the regulation member.

As a result, the printable area of the recording medium decreases. Further, since the driving assembly of the guide member is provided in at least one of the gap between the conveyance roller and the carriage and the gap between the carriage and the sheet discharge roller, the size of the apparatus body increases. Moreover, since the guide member, the guide rail, the driving unit, and the like are respectively provided at the upstream side and the downstream side, the apparatus configuration becomes complicated, and hence the number of components increases.

On the contrary, when one guide member supports (holds) the upstream side and the downstream side of the regulation member and is movable in the main scanning direction as in this embodiment, it is possible to reduce a failure caused when the upstream side and the downstream side are supported by separate guide members.

Figure 24:
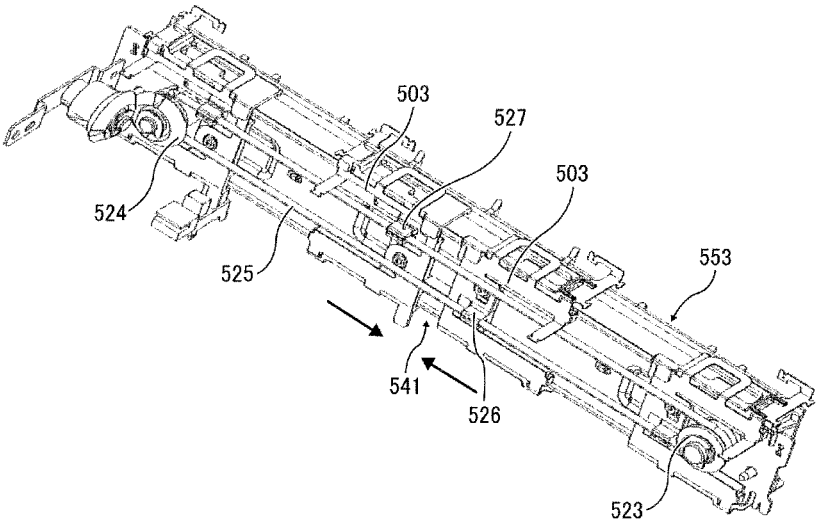
FIG. 24 is a perspective illustrating a platen member according to an eighth embodiment of this disclosure.

Next, an eighth embodiment of this disclosure will be described with reference to FIG. 24. FIG. 24 is a perspective view illustrating a platen member according to the eighth embodiment.

In this embodiment, an abutting portion 541 is provided which causes the moving member 503 to abut against the platen member 553.

Then, the reference position of the regulation member 504 is detected by detecting a change in motor load, which occurs when the moving members 503 are respectively moved in the arrow direction (by a belt moving in a single direction) to abut against the abutting portion 541, through a current value or the like.

Thus, it is possible to omit a sensor for detecting the reference position of the regulation member 504.

Next, an example of a control in the use/non-use state of the regulation member 504 will be described.

For example, when the uplift amount at the end of the recording medium is small at the single face printing and the double face printing with a small ejection amount, the regulation member is not used. Further, even when the regulation member is used at the double face printing, it is possible to decrease the standby time caused by the positioning of the regulation member by the configuration in which the medium width direction result in the case of a print operation performed on a first surface is stored and the regulation member is moved for a medium reversing time up to a print operation performed on a second surface.

Figure 25:
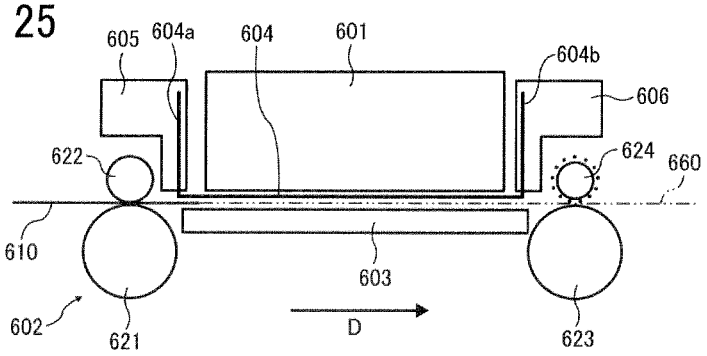
FIG. 25 is a side view illustrating a ninth embodiment of this disclosure.

Hereinafter, a ninth embodiment of this disclosure will be described with reference to FIG. 25. FIG. 25 is a side view illustrating the ninth embodiment.

An image forming apparatus includes a recording head 601 which is configured as a liquid ejection head such as an image forming unit forming an image on a recording medium (hereinafter, referred to as a "sheet") 610 and a conveyor 602 which opposes the recording head 601 as the image forming unit and conveys the sheet 610.

The conveyor 602 includes a conveyance roller 621 and a pressing roller 622 which serve as a pair of upstream-side rotary bodies disposed at the upstream side of the recording head 601 in the medium conveyance direction D and includes a sheet discharge roller 623 and a spur roller 624 which serve as a pair of downstream-side rotary bodies disposed at the downstream side of the recording head 601 in the medium conveyance direction.

A platen member 603 which opposes the recording head 601 and guides the sheet 610 is disposed between the pair of the conveyance roller 621 and the pressing roller 622 and the pair of the sheet discharge roller 623 and the spur roller 624. The guide surface side of the platen member 603 forms a conveyance passage 660 for the sheet 610.

Then, a regulation member 604 which presses the sheet 610 (to regulate the uplift) is disposed between the recording head 601 and the platen member 603 forming the conveyance passage 660 for the sheet 610. The regulation member 604 is formed of for example, a string-shaped member such as a silk gut line and a thin-layer member such as a PET film.

An upstream-side support portion 605 which supports the regulation member 604 at the upstream side of the recording head 601 in the medium conveyance direction and a downstream-side support portion 606 which supports the regulation member 604 at the downstream side of the recording head 601 in the medium conveyance direction are provided.

The regulation member 604 includes a portion 604*a* which approaches to (extends relative to) the conveyance passage 660 for the sheet 610 in the vertical direction and is provided between the recording head 601 and the pair of the conveyance roller 621 and the pressing roller 622 as the pair of upstream-side rotary bodies.

Further, the regulation member 604 includes a portion 604*b* which moves away from (extends relative to) the recording medium conveyance passage 660 in the vertical direction and is provided between the recording head 601 and the pair of the sheet discharge roller 623 and the spur roller 624 as the pair of downstream-side rotary bodies.

Furthermore, in this disclosure, the language that the portion approaches to the recording medium conveyance passage 660 in the vertical direction indicates that the portion approaches (extends) from a position opposing the conveyance passage 660 toward the conveyance passage 660, and does not necessarily means that the portion approaches to the conveyance passage 660 in the exactly vertical direction. For example, in this embodiment, the "portion which approaches to the conveyance passage 660 in the vertical direction" may be the portion which is directed from the upside of the conveyance passage 660 toward the downside thereof, and is not limited to a portion which is disposed in the vertical direction with respect to the conveyance passage 660. Then, a portion which is disposed in an inclined direction with respect to the conveyance passage 660 is also included. Further, the same applies to the language that the portion moves away from the conveyance passage 660.

Then, the regulation member 604 in the range from the lowest end of the portion 604*a* to the lowest end of the portion 604*h* is disposed so as to pass between the recording head 601 and the platen member 603.

In this way, since both ends of the regulation member 604 in the medium conveyance direction are respectively supported by the upstream-side support portion 605 and the downstream-side support portion 606, the regulation member 604 may be stably and reliably held at the necessary position between the recording head 601 and the platen member 603.

Thus, since the regulation member 604 may be formed as a thin member or a string-shaped member, the uplift of the sheet from the conveyance passage 660 is reduced, the gap between the image forming unit and the sheet is narrowed, and hence a narrow gap may be ensured between the image forming unit and the sheet.

Here, as described above, the regulation member 604 includes the portion 604*a* which approaches to the recording medium conveyance passage 660 in the vertical direction and is provided between the recording head 601 and the pair of the conveyance roller 621 and the pressing roller 622. Thus, there is no need to widen the gap between the recording head 601 and the pair of the conveyance roller 621 and the pressing roller 622 in order to dispose the regulation member 604, and hence the apparatus may be decreased in size.

Further, the regulation member 604 includes the portion 604*b* which moves away from the recording medium conveyance passage 660 in the vertical direction and is provided between the recording head 601 and the pair of the sheet discharge roller 623 and the spur roller 624. Thus, there is no need to widen the gap between the recording head 601 and the pair of the sheet discharge roller 623 and the spur roller 624 in order to dispose the regulation member 604, and hence the apparatus may be decreased in size.

Figure 26:
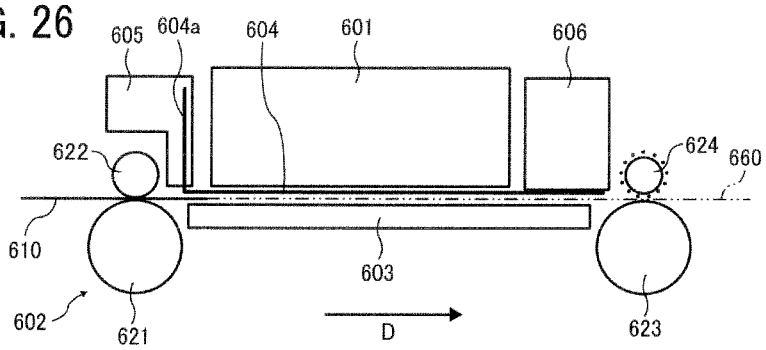
FIG. 26 is a side view illustrating a tenth embodiment of this disclosure.

A tenth embodiment of this disclosure will be described with reference to FIG. 26. FIG. 26 is a side view illustrating the tenth embodiment.

This embodiment is different from the ninth embodiment in that the regulation member 604 includes the portion 604*a* which approaches to the recording medium conveyance passage 660 in the vertical direction and is provided between the recording head 601 and the pair of the conveyance roller 621 and the pressing roller 622, but does not include a downstream-side portion 604*b* which moves away from the recording medium conveyance passage 660 in the vertical direction.

Even in such a configuration, there is no need to widen the gap between the recording head 601 and the pair of the conveyance roller 62*l* and the pressing roller 622 in order to dispose the regulation member 604, and hence the apparatus may be decreased in size.

Figure 27:
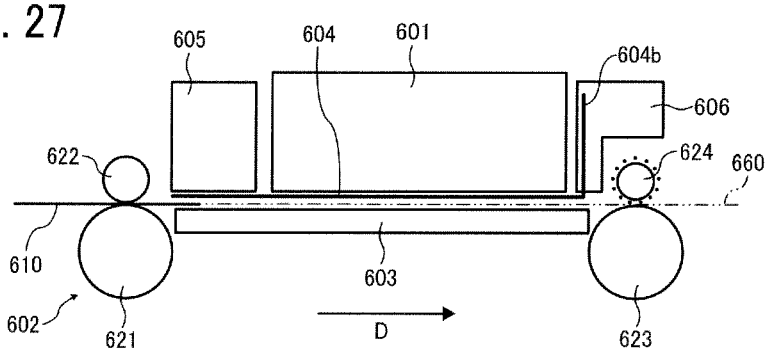
FIG. 27 is a side view illustrating an eleventh embodiment of this disclosure.

An eleventh embodiment of this disclosure will be described with reference to FIG. 27. FIG. 27 is a side view illustrating the eleventh embodiment.

This embodiment is different from the ninth embodiment in that the regulation member 604 includes the portion 604*b* which moves away from the recording medium conveyance passage 660 in the vertical direction and is provided between the recording head 601 and the pair of the sheet discharge roller 623 and the spur roller 624, but does not include an upstream-side portion 604*a* which approaches to the recording medium conveyance passage 660 in the vertical direction.

Even in such a configuration, there is no need to widen the gap between the recording head 601 and the pair of the sheet discharge roller 623 and the spur roller 624 in order to dispose the regulation member 604, and hence the apparatus may be decreased in size.

Figure 28:
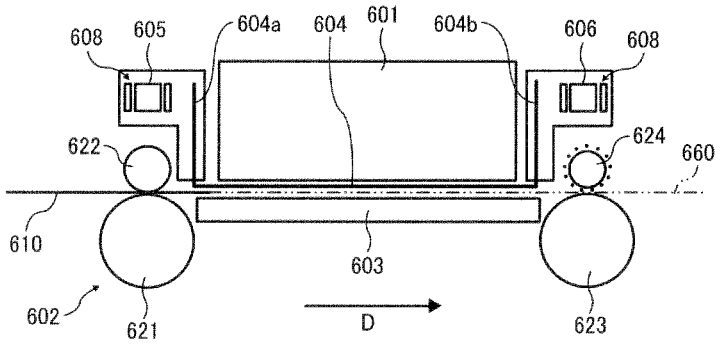
FIG. 28 is a side view illustrating a twelfth embodiment of this disclosure.
Figure 29:
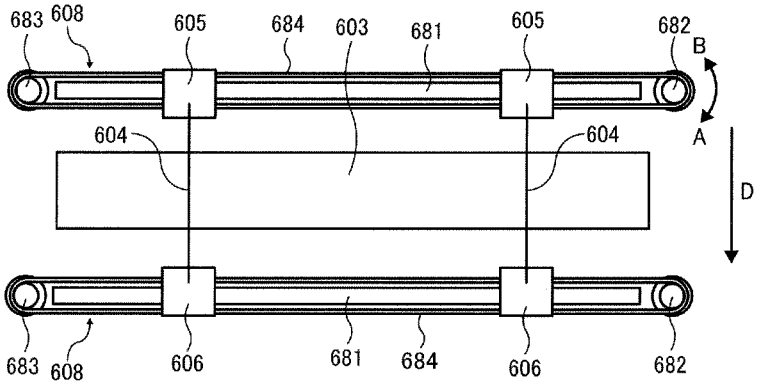
FIG. 29 is a plan view illustrating the twelfth embodiment.

Next, a twelfth embodiment of his disclosure will be described with reference to FIGS. 28 and 29. FIG. 28 is a side view illustrating the twelfth embodiment, and FIG. 29 is a plan view illustrating the twelfth embodiment.

In this embodiment, a driving assembly 608 as a driving unit is provided which moves the upstream-side support portion 605 and the downstream-side support portion 606 in a direction perpendicular to the medium conveyance direction.

The driving assembly 608 includes a guide rail 681 which guides the upstream-side support portion 605 and the downstream-side support portion 606, a timing belt 684 which is wound around pulleys 682 and 683 and, a driving source which rotates the pulley 682, and the upstream-side support portion 605 or the downstream-side support portion 606 is connected to the timing belt 684.

Here, each of the upstream-side support portion 605 and the downstream-side support portion 606 is disposed at two positions so as to regulate the end of the sheet 610 in the width direction (the main scanning direction). Then, two upstream-side support portions 605 are connected to different surfaces of the loop-shaped timing belt 684. Similarly, two upstream-side support portions 605 are connected to different surfaces of the loop-shaped timing belt 684.

Thus, two upstream-side support portions 605 move in a direction moving away from each other by the rotation of the timing belt 684 in one direction (for example, the direction indicated by arrow A). Further, two upstream-side support portions 605 move in a direction moving close to each other by the rotation of the timing belt 684 in the other direction (for example, the direction indicated by arrow B). Further, the same applies to the movement of two downstream-side support portions 606.

With such a configuration, when the upstream-side support portion 605 and the downstream-side support portion 606 are moved by the driving assembly 608, the regulation members 604 may be moved to a necessary position in response to the width of the sheet 610.

Furthermore, the driving assembly may be a feed screw or a ball screw. When such a screw is used, the rotation of the support portions 605 and 606 is regulated. Further, a driving source such as a linear motor that directly moves the support portions 605 and 606 may be also used.

Here, a clearance of a sheet jam will be described.

As described above, when the sheet jam occurs in the state where the regulation member 604 is disposed between the conveyance passage 660 and the recording head 601, the regulation member may disturb (cause an interference) when a user performs a jam clearance of removing the sheet 610 causing the jam in that the sheet 610 exists between the regulation member 604 and the platen member 603. Further, there is a concern that the regulation member 604 may be damaged.

Therefore, when the sheet jam is detected due to the occurrence of the sheet jam, e recording head 601 is moved in a direction moving away from the sheet 610 or the direction opposite to the direction when the jam does not occur. However, the regulation member 604 is also moved in the same direction as the recording head 601.

Thus, it is possible to prevent the regulation member 604 from disturbing the jam clearance.

Furthermore, the jam may be detected by a change in voltage value of the moving unit moving the recording head 601, a change in speed of the recording head 601, or the optical sensor.

Figure 30:
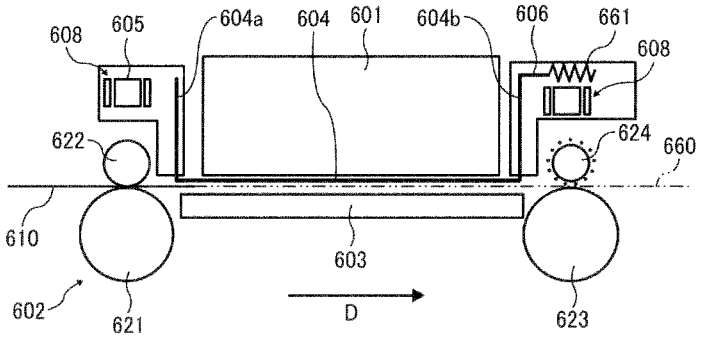
FIG. 30 is a side view illustrating a thirteenth embodiment of this disclosure.

Next, a thirteenth embodiment of this disclosure will be described with reference to FIG. 30. FIG. 30 is a side view illustrating the thirteenth embodiment.

In this embodiment, the downstream-side support portion 606 is provided with a tension application member 661 that applies a tension to the regulation member 604. Furthermore, the upstream-side support portion 605 may be provided with the tension application member 661 instead of the downstream-side support portion 606 or along with the downstream-side support portion 606.

Since the tension application member 661 is provided, a tension is reliably applied to the regulation member 604, and hence the regulation member 604 may be held at a necessary position.

Figure 31:
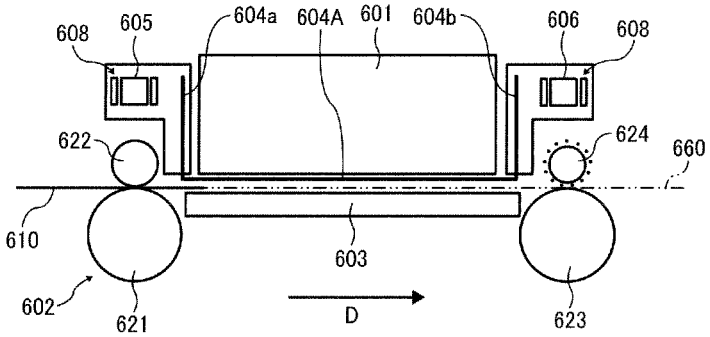
FIG. 31 is a side view illustrating a fourteenth embodiment of this disclosure.

Next, a fourteenth embodiment of this disclosure will be described with reference to FIG. 31. FIG. 31 is a side view illustrating the fourteenth embodiment.

In this embodiment, a regulation member 604A is formed as an elastic member.

Thus, a tension may be obtained by the regulation member 604A without providing a separate tension application member as in the thirteenth embodiment.

Figure 32:
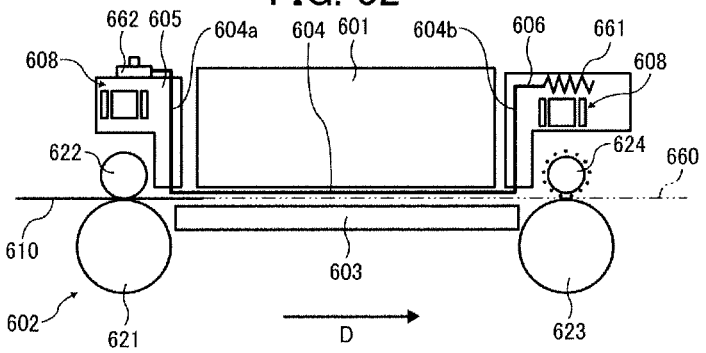
FIG. 32 is a side view illustrating a fifteenth embodiment of this disclosure.
Figure 33:
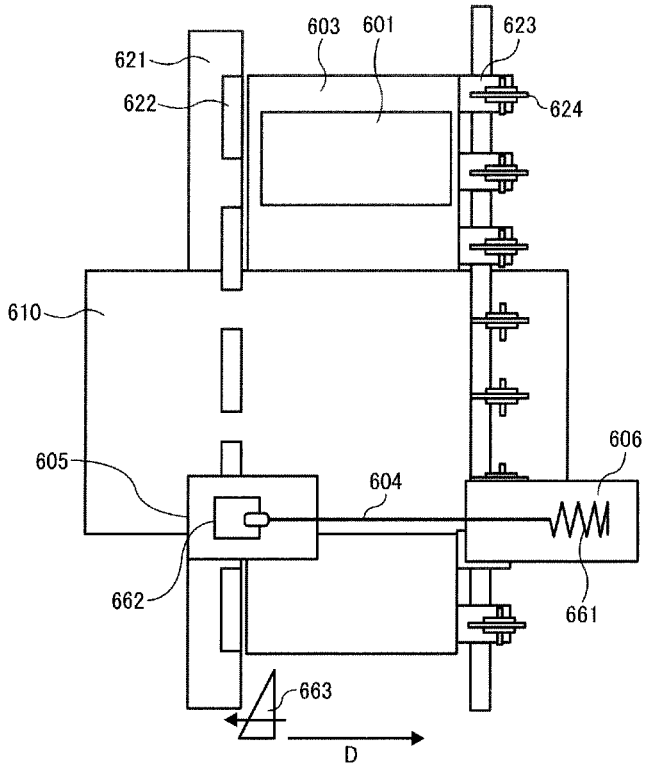
FIG. 33 is a plan view illustrating the fifteenth embodiment.

Next, a fifteenth embodiment of this disclosure will be described with reference to FIGS. 32 and 33. FIG. 32 is a side view illustrating the fifteenth embodiment, and FIG. 33 is a plan view illustrating the fifteenth embodiment.

In this embodiment, in the configuration of the thirteenth embodiment, the upstream-side support portion 605 is provided with a tension release member 662 that releases the tension of the regulation member 604. The tension release member 662 is adapted to be separated when a predetermined amount or more of force is applied to the regulation member 604. For example, the tension release member 662 is fixed to a support portion 5 through a pawl portion, and the pawl-shaped portion is adapted to be separated by a predetermined amount or more of force.

Further, a tension restoration member 663 is provided which restores the tension released by the tension release member 662.

With such a configuration, when a large force is applied to the regulation member 604 due to the sheet in the event of the jam, the sheet lifts the regulation member 604 upward. Thus, when the regulation member collides with (interferes with) the recording head 601, the tension of the regulation member 604 is released by the tension release member 662. When the tension of the regulation member 604 is released, the allowance length of the regulation member 604 increases.

Since the allowance (the length) of the regulation member 604 increases due to the release of the tension, the damage of the regulation member 604 or the degradation in operability for the jam clearance may be prevented.

Further, since the projection of the tension release member 662 is guided by the tension restoration member 663 in a manner such that the tension release member 662 which is separated once moves the regulation member 604 to the position of the tension restoration member 663, the tension may be returned to the tension generation position.

The tension restoration member 663 is not limited to the guide type, and may be operated by the power of an actuator such as a motor or a solenoid. Further, the tension release member 662 may not be held by the pawl-shaped portion, and may be held by the other holding unit such as a magnet.

Figure 34:
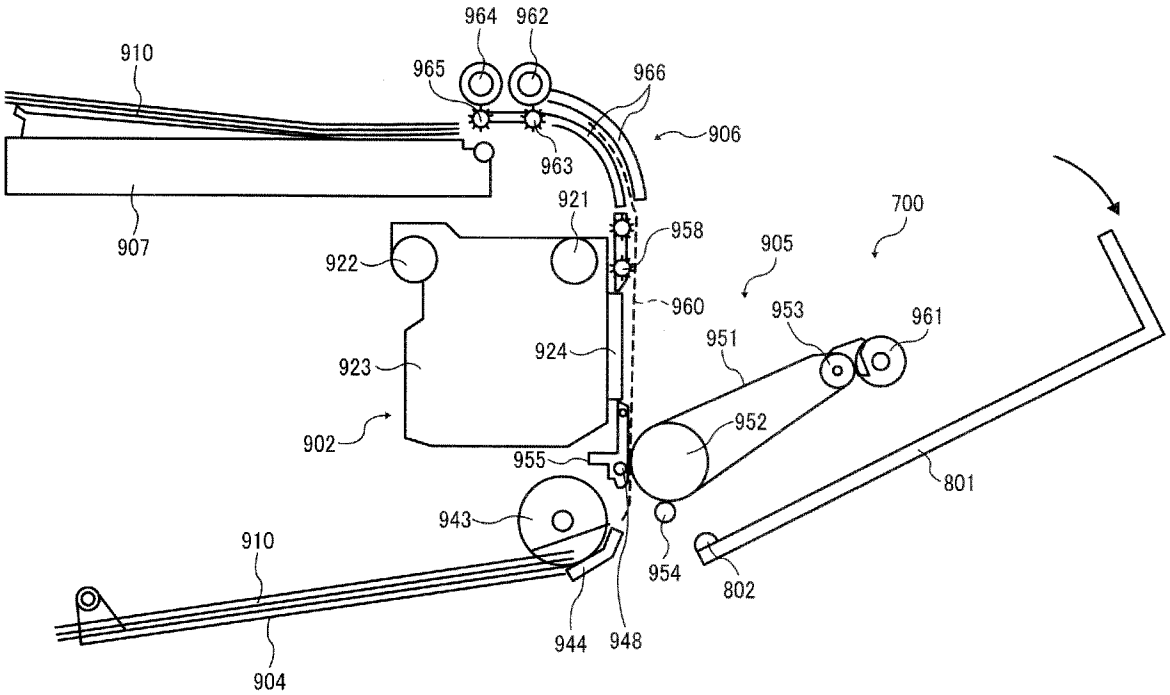
FIG. 34 is a side view illustrating a sixteenth embodiment of this disclosure.

Next, a sixteenth embodiment of this disclosure will be described with reference to FIG. 34. FIG. 34 is a side view illustrating the sixteenth embodiment.

In this embodiment, an apparatus body includes therein an image forming section 902 as an image forming unit, a conveyance assembly 905 as a conveyor, and the like, and a sheet feed tray 904 capable of stacking a sheet 910 as a recording medium thereon is provided at the lower side of the apparatus body. Furthermore, the sheet feed tray 904 is used as a sheet feed unit while including a sheet feed cassette.

Then, the sheet 910 fed from the sheet feed tray 904 is obtained, and the image forming section 902 records a necessary image by ejecting a droplet in the horizontal direction while the sheet 910 is intermittently conveyed in the vertical direction by the conveyance assembly 905 as the conveyor. The sheet 910 having an image formed thereon is further conveyed upward through a sheet discharge conveyance section 906, and is discharged to a sheet discharge tray 907 as a sheet discharge unit provided at the upper side of the apparatus body.

Here, the image forming section 902 movably holds a carriage 923 equipped with a recording head 924 by a main guide member 921 and a sub-guide member 922. The carriage 923 moves while performing a scan operation in the main scanning direction through a timing belt stretched between a driving pulley and a driven pulley by a main scanning motor of a carriage moving assembly.

The carriage 923 is equipped with a recording head 924 as a liquid ejection head used to eject ink droplets of respective colors of yellow (Y), magenta (M), cyan (C), and black (K).

The recording head 924 is attached so that the droplet ejecting direction becomes the horizontal direction while nozzle rows each having a plurality of nozzles are arranged in the sub-scanning direction perpendicular to the main scanning direction. That is, employed is a horizontal typing type including the recording head 924 in which a nozzle face provided with nozzles for ejecting a droplet is disposed in the vertical direction and a droplet is ejected in the horizontal direction.

The sheet 910 of the sheet feed tray 904 is separated one by one by a sheet feed roller (semi-lunar roller) 943 and a separation pad 944, and is fed into the apparatus body. The fed sheet 910 is conveyed to a gap between a pressing roller 948 and a conveyance belt 951 of the conveyance assembly 905, and is conveyed while being adsorbed to the conveyance belt 951.

The conveyance assembly 905 includes the endless conveyance belt 951 which is stretched between a conveyance roller 952 as a driving roller and a driven roller 953 and a charging roller 954 which charges the conveyance belt 951.

Further, the pressing roller 948 is held by a leading-end pressing plate 955. Further, a spur roller 958 opposing the driven roller 953 is provided.

The sheet discharge conveyance section 906 includes a sheet discharge conveyance roller 961, a conveyance roller 962, a spur roller 963, a sheet discharge roller 964, a spur roller 965, a guide member 966, and the like.

Then, in the image forming apparatus, the front surface side of the apparatus body is provided with a front cover 801 as an openable cover which is openable and closable about a support shaft 802. Further, the conveyance belt 951, the conveyance roller 952, the driven roller 953, and the sheet discharge conveyance roller 961 are integrated with as a conveyance unit 700 as a conveyance section. Then, the conveyance unit 700 is provided so as to be openable and closable about the shaft of the conveyance roller 952.

Thus, a conveyance passage 960 may be opened by opening the front cover 801 and the conveyance unit 700.

Even in the image forming apparatus with such a configuration, a regulation member may be provided as in the ninth to sixteenth embodiments.

In this way, in the case of the configuration in which the conveyance passage 960 is opened in the event of the jam, the pressure of the sheet caused by the jam opens the conveyance unit 700, and hence the operation of the regulation member is not needed.

Here, in the case of the jam in which the sheet is tangled by the regulation member, it is desirable that the sheet move in a direction in which the sheet collides with the regulation member (that is, the recording head moving direction) due to the jam.

At this time, in the case where the strength of the regulation member is not strong, there is a possibility that the regulation member may be damaged when the regulation member moves before the conveyance unit is opened, and hence it is desirable to move the regulation member after the conveyance unit is opened.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

an image forming unit to form an image on a recording medium;

a conveyor disposed opposing the image forming unit to convey the recording medium in a medium conveyance direction along a conveyance passage at which the image forming unit forms the image on the recording medium; and a string-shaped regulation member having two open ends and extending from one open end thereof up stream in the medium conveyance direction to the other open end thereof downstream in the medium conveyance direction, the string-shaped regulation member being disposed between the image forming unit and the conveyance passage at which the image forming unit forms the image on the recording medium, to regulate a distance between the recording medium and the image forming unit within a certain range.

2. The image forming apparatus according to claim 1, further comprising:

a guide member to support the regulation member at an upstream side and a downstream side from the image forming unit in a medium conveyance direction of the recording medium, wherein the guide member is disposed so as to be movable in a direction perpendicular to the medium conveyance direction.

3. The image forming apparatus according to claim 1, wherein the guide member is disposed at a same side as a side at which the image forming unit is disposed, relative to a position of the regulation member between the image forming unit and the conveyance passage.

4. The image forming apparatus according to claim 1, further comprising a holder to hold the regulation member; and an elastic member via which the holder holds the regulation member.

5. The image forming apparatus according to claim 1, further comprising:

a rotary body disposed at at least one of an upstream side and a downstream side of the image forming unit in a medium conveyance direction of the recording medium, wherein the regulation member is disposed so as to pass a side opposite to the conveyance passage relative to the rotary body.

6. The image forming apparatus according to claim 1, further comprising a holding portion to hold at least one end of the regulation member, wherein the holding portion is separately provided from the guide member, and the guide member holds a halfway portion of the regulation member.

7. The image forming apparatus according to claim 6, further comprising a carriage mounting the image forming unit, wherein the holding portion is disposed outside a scanning area of the carriage.

8. The image forming apparatus according to claim 6, wherein the holding portion is provided in a conveyance passage forming member or a member holding the conveyance passage forming member.

9. The image forming apparatus according to claim 6, wherein the guide member includes a laid portion having an obtuse or a curved shape on which the regulation member is laid.

10. The image forming apparatus according to claim 1, further comprising:

a wiping member to wipe off a circumferential surface of the regulation member.

11. The image forming apparatus according to claim 1, wherein the conveyor includes a conveyance guide member to guide the recording medium and a guide member to support the regulation member at an upstream side and a downstream side of the image forming unit in a medium conveyance direction of the recording medium, and the guide member is provided on the conveyance guide member so as to be movable in a direction perpendicular to the medium conveyance direction.

12. The image forming apparatus according to claim 11, wherein the guide member includes an upstream-side holding portion to support the regulation member at the upstream side of the image forming unit in the medium conveyance direction, a downstream-side holding portion to support the regulation member at the downstream side of the image forming unit in the medium conveyance direction, a connecting portion to connect the upstream-side holding portion and the downstream-side holding portion to each other, and a moving member disposed at a first side of the conveyance guide member opposite a second side of the conveyance guide member at which the conveyance guide member guides the recording medium, the moving member being movable in a direction perpendicular to the medium conveyance direction, and wherein the connecting portion is attached to the moving member.

13. An image forming apparatus comprising:

an image forming unit to form an image on a recording medium;

a conveyor disposed opposing the image forming unit to convey the recording medium in a medium conveyance direction along a conveyance passage at which the image forming unit forms the image on the recording medium, the conveyor including a pair of upstream-side rotary bodies at an upstream side of the image forming unit in the medium conveyance direction of the recording medium and a pair of downstream-side rotary bodies at a downstream side of the image forming unit in the medium conveyance direction; and a regulation member including a string-shaped member having two open ends and extending from one open end thereof upstream in the medium conveyance direction to the other open end thereof downstream in the medium conveyance direction, the string-shaped regulation member being disposed between the image forming unit and the conveyance passage at which the image forming unit forms the image on the recording medium, to regulate the recording medium, the regulation member further including an upstream-side support portion at an upstream side of the image forming unit in the medium conveyance direction to support the string-shaped member at the upstream side and a downstream-side support portion at a downstream side of the image forming unit in the medium conveyance direction to support the string-shaped member at the downstream side, the regulation member additionally including a portion that is disposed between the pair of upstream-side rotary bodies and the image forming unit and extends in a vertical direction relative to the conveyance passage.

14. The image forming apparatus according to claim 13, further comprising a driving assembly to move the regulation member in a direction perpendicular to the medium conveyance direction, wherein, relative to the conveyance passage, the driving assembly is disposed at a same side as a side at which the image forming unit is disposed.

15. The image forming apparatus according to claim 13, further comprising a tension application member to apply tension to the string-shaped member.

16. The image forming apparatus according to claim 15, further comprising a tension release member to release tension to the string-shaped member.

17. The image forming apparatus according to claim 13, wherein the string-shaped member is an elastic member.

18. The image forming apparatus according to claim 13, further comprising a driving assembly to move the regulation member in a direction perpendicular to the medium conveyance direction, wherein, in response to detection of a jam of the recording medium, the driving assembly retracts the regulation member.

19. An image forming apparatus comprising:

an image forming unit to form an image on a recording medium;

a conveyor disposed opposing the image forming unit to convey the recording medium in a medium conveyance direction along a conveyance passage at which the image forming unit forms the image on the recording medium, the conveyor including a pair of upstream-side rotary bodies at an upstream side of the image forming unit in the medium conveyance direction of the recording medium and a pair of downstream-side rotary bodies at a downstream side of the image forming unit in the medium conveyance direction; and a regulation member including a string-shaped member having two open ends and extending from one open end thereof upstream in the medium conveyance direction to the other open end thereof downstream in the medium conveyance direction, the string-shaped regulation member being disposed between the image forming unit and the conveyance passage at which the image forming unit forms the image on the recording medium, to regulate the recording medium, the regulation member further including an upstream-side support portion at an upstream side of the image forming unit in the medium conveyance direction to support the string-shaped member at the upstream side and a downstream-side support portion at a downstream side of the image forming unit in the medium conveyance direction to support the string-shaped member at the downstream side, the regulation member additionally including a portion that is disposed between the pair of downstream-side rotary bodies and the image forming unit and extends in a vertical direction relative to the conveyance passage.

20. The image forming apparatus according to claim 1, further comprising:

an upstream-side holder coupled to, and holding, the one open end of the string-shaped member, upstream in the medium conveyance direction; and a downstream-side holder coupled to, and holding, the other open end of the string-shaped member, downstream in the medium conveyance direction.

* * * * *